US010957235B1

(12) United States Patent
Buckley

(10) Patent No.: US 10,957,235 B1
(45) Date of Patent: Mar. 23, 2021

(54) COLOR SHIFT CORRECTION FOR DISPLAY DEVICE

(71) Applicant: Facebook Technologies, LLC, Menlo Park, CA (US)

(72) Inventor: Edward Buckley, Melrose, MA (US)

(73) Assignee: Facebook Technologies, LLC, Menlo Park, CA (US)

( * ) Notice: Subject to any disclaimer, the term of this patent is extended or adjusted under 35 U.S.C. 154(b) by 115 days.

(21) Appl. No.: 16/260,847

(22) Filed: Jan. 29, 2019

Related U.S. Application Data

(60) Provisional application No. 62/497,318, filed on Oct. 24, 2018.

(51) Int. Cl.
*G09G 5/02* (2006.01)
*G09G 3/20* (2006.01)
(Continued)

(52) U.S. Cl.
CPC ..... *G09G 3/2003* (2013.01); *G09G 3/2044* (2013.01); *G09G 3/32* (2013.01);
(Continued)

(58) Field of Classification Search
CPC ..... G09G 3/2003; G09G 2320/0666; G09G 2340/06; G09G 2320/0242; G09G 2300/0452; G09G 3/3406; G09G 3/3413; G09G 5/026; G09G 5/06; G09G 3/3233; G09G 2320/0209; G09G 3/3208;
(Continued)

(56) References Cited

U.S. PATENT DOCUMENTS 8,928,685 B2 * 1/2015 Kim ..... G09G 5/02 345/590
2007/0115228 A1 * 5/2007 Roberts ..... G09G 3/3413 345/82

(Continued)

OTHER PUBLICATIONS

Kang, D-W. et al., "Color Decomposition Method for Multi-Primary Display Using 3D-LUT in Linearized LAB Space," Color Imaging X: Processing, Hardcopy, and Applications, Proceedings of SPIE—IS&T Electronic Imaging—the International Society for Optical Engineering, Jan. 2005, pp. 354-363, vol. 5667.

(Continued)

*Primary Examiner* — Duc Q Dinh
(74) *Attorney, Agent, or Firm* — Fenwick & West LLP

(57) ABSTRACT

A color mapping and correction scheme for processing pixel data allows a display device to account for color shift. The display device drives its light emitters with different current levels. The light emitters exhibit a color shift in gamut. As such, the display device generate light of two different color gamut regions. An input pixel data may include an original color coordinate that is beyond a common color gamut that is common to the two gamut regions. A mapping scheme is used to convert the original color coordinate to an updated color coordinate within the common color gamut. A first output color coordinate that corrected for the shift in first emitters is generated for the operation of the first light emitters based on the updated color coordinate. A second output color coordinate that corrected for the shift in second emitters is also generated based on the updated color coordinate.

16 Claims, 15 Drawing Sheets

(51) Int. Cl.
*G09G 3/32* (2016.01)
*G09G 5/06* (2006.01)

(52) U.S. Cl.
CPC ..... *G09G 5/06* (2013.01); *G09G 2320/0242* (2013.01); *G09G 2320/064* (2013.01); *G09G 2340/06* (2013.01)

(58) Field of Classification Search
CPC ..... G09G 5/02; G09G 2330/021; G09G 3/22; G09G 2320/043; G09G 3/32; G09G 3/3433; G09G 2320/0214; G02B 6/0073; G02B 30/23; G02B 27/017; G02F 1/133514; G02F 1/133603; G02F 1/133615; G02F 1/133621; G02F 1/133604; G02F 1/13475
USPC ..... 345/102
See application file for complete search history.

(56) References Cited

U.S. PATENT DOCUMENTS

2012/0212515 A1* 8/2012 Hamer ..... G09G 3/3607 345/690
2015/0070402 A1* 3/2015 Shah ..... G09G 3/20 345/690

OTHER PUBLICATIONS

Kerr, D.A., "The CIE XYZ and xyZ Color Spaces," Mar. 21, 2010, pp. 1-16, Issue 1.
Motomura, H., "Color Conversion for a Multi-Primary Display Using Linear Interpolation on Equi-Luminance Plane Method (LIQ-UID)," Journal of the SID, 2003, pp. 371-378, vol. 11, No. 2.

* cited by examiner

COLOR SHIFT CORRECTION FOR DISPLAY DEVICE

CROSS REFERENCE TO RELATED APPLICATIONS

This application claims the benefit of U.S. Provisional Patent Application Ser. No. 62/497,318, filed on Oct. 24, 2018, the content of which is incorporated herein by reference in its entirety for all purposes.

BACKGROUND

This disclosure relates to structure and operation of a display device and more specifically to color mapping and correction that account for the color shift of a display device.

A display device is often used in a virtual reality (VR) or augmented-reality (AR) system as a head-mounted display or a near-eye display. The precise color may be generated by a collection of primary light colors emitted by different light emitters. When there is a color shift in one or more light emitters, the primary light colors in the display device are shifted and the overall image quality of the display device is affected. The shift in color can result in various visual artifacts, thus negatively impacting the user experience with the VR or AR system.

SUMMARY

Embodiments described herein generally relate to color mapping and correction operations for a display device that exhibits color shifts in its light emitters. Because of various reasons such as driving current levels, light emitters may exhibit certain degrees of color shift. In one embodiment, the light emitters of a display device can be classified as first light emitters and second light emitters. To precisely display a color value, the display device drives the first light emitters at a first current level to emit light that represents the most significant bits (MSBs) the color value and drives the second light emitters at a lower current level to emit light that represents the least significant bits (LSBs) of the color value in order to fine tune the color. However, as a result of the different driving current levels, a color shift is exhibited between the first light emitters and the second light emitters so that the gamut regions of those light emitters do not match. Put differently, the difference in current levels not only affects the brightness of the light emitters, but also shifts the light emitters' wavelengths.

In accordance with embodiment, an image processing operation is used to process input pixel data in order to account for the color shift. A display device may receive pixel data from various sources such as a computer, a portable electronic device, etc. The pixel data may be in a color coordinate space that is not specifically designed based on the color gamut of the display device because the color coordinate space may be in a standardized form that is used for a wide variety of devices. Hence, the input pixel data may include an original color coordinate that is not ready to be displayed without further processing. In some cases, the original color coordinate is beyond a common color gamut that is common to a first color gamut generated by the first light emitters and a second color generated by second light emitters.

In accordance with an embodiment, after receiving the input pixel data, the display device converts the input pixel data to updated pixel data according to a mapping scheme. The updated pixel data includes an updated color coordinate that is within the common color gamut. The mapping scheme can include a transformation matrix or a look-up table. Since the updated color coordinate is within the common color gamut, it can easily be adjusted and displayed by both the first light emitters and the second light emitters. The display device generates a first output color coordinate for the first light emitters to produce first light in accordance with the first color gamut. The generation of the first output color coordinate is based on the updated pixel data with a correction that accounts for the color shift of the first light emitters. By the same token, the display device generates a second color coordinate for the second light emitters to produce second light in accordance with the second color gamut. The generation of the second output color coordinate is also based on the updated pixel data with correction that accounts for the color shift of the second light emitters. As a result, the first and second light emitters can be made to match despite the color shift.

The figures depict embodiments of the present disclosure for purposes of illustration only.

DETAILED DESCRIPTION

Embodiments relate to display devices that include color mapping and correction operations for processing pixel data to account for the color shift in the light emitters. A display device may use two or more pulse width modulation (PWM) schemes to drive light emitters at different current levels. The light emitters exhibit color shift because of different levels of driving current. Color mapping and correction operations are carried out to account for the color shift so that the display device can produce colors precisely. The operations may include converting an input color coordinate to an updated color coordinate that is within the gamut that is common to all light emitters. The operations may also include, based on the updated color coordinate, generating different output color coordinates for different light emitters to individually account for the color shift of each light emitter.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

Near-Eye Display

Figure 1:
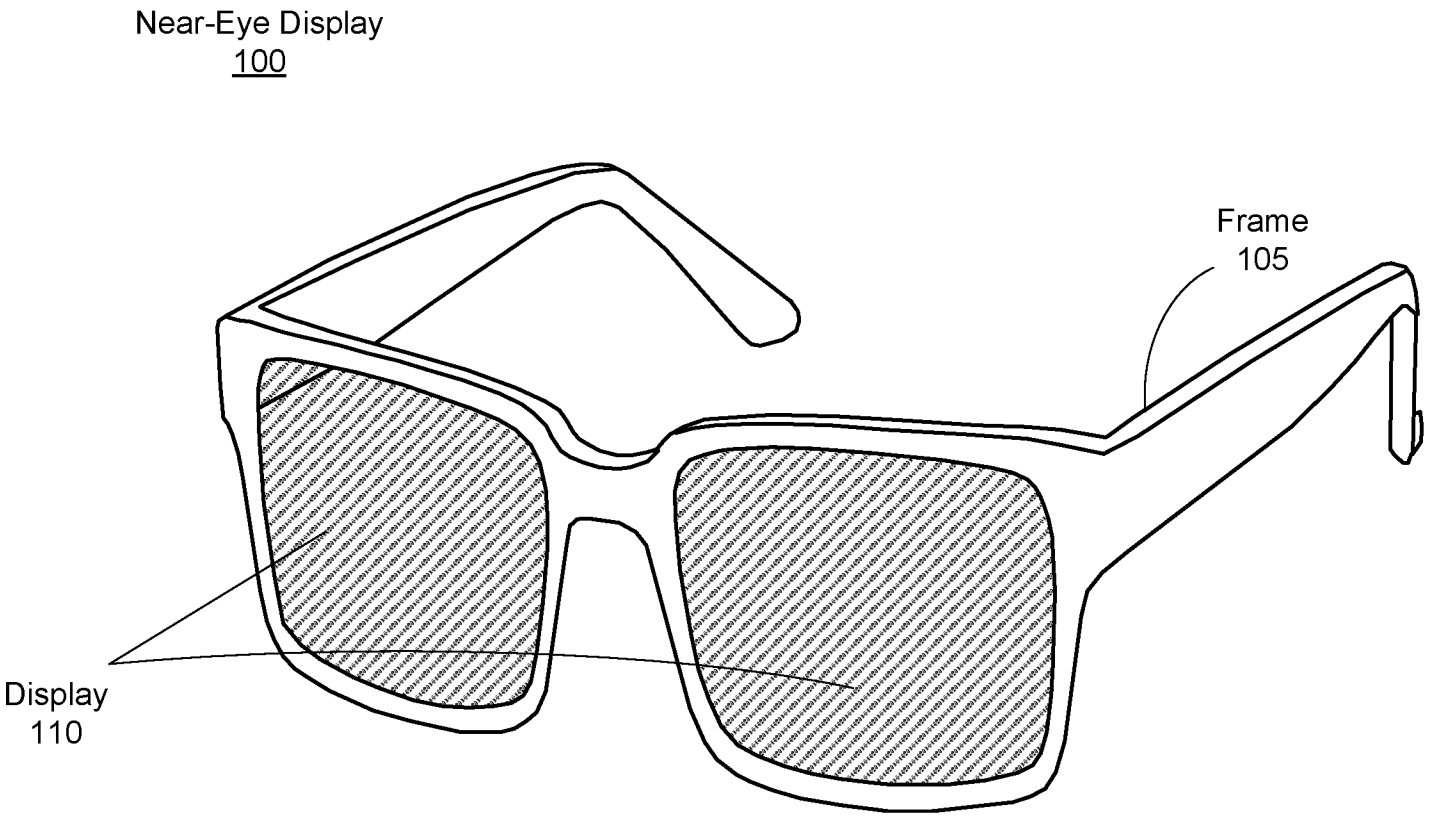
FIG. 1 is a perspective view of a near-eye-display (NED), in accordance with an embodiment.

Figure (FIG. 1 is a diagram of a near-eye display (NED) 100, in accordance with an embodiment. The NED 100 presents media to a user. Examples of media presented by the NED 100 include one or more images, video, audio, or some combination thereof. In some embodiments, audio is presented via an external device (e.g., speakers and/or headphones) that receives audio information from the NED 100, a console (not shown), or both, and presents audio data based on the audio information. The NED 100 may operate as a VR NED. However, in some embodiments, the NED 100 may be modified to also operate as an augmented reality (AR) NED, a mixed reality (MR) NED, or some combination thereof. For example, in some embodiments, the NED 100 may augment views of a physical, real-world environment with computer-generated elements (e.g., images, video, sound, etc.).

The NED 100 shown in FIG. 1 includes a frame 105 and a display 110. The frame 105 includes one or more optical elements which together display media to users. The display 110 is configured for users to see the content presented by the NED 100. As discussed below in conjunction with FIG. 2, the display 110 includes at least a source assembly to generate an image light to present media to an eye of the user. The source assembly includes, e.g., a light source, an optics system, or some combination thereof.

FIG. 1 is only an example of a VR system. However, in alternate embodiments, FIG. 1 may also be referred to as a Head-Mounted-Display (HMD).

Figure 2:
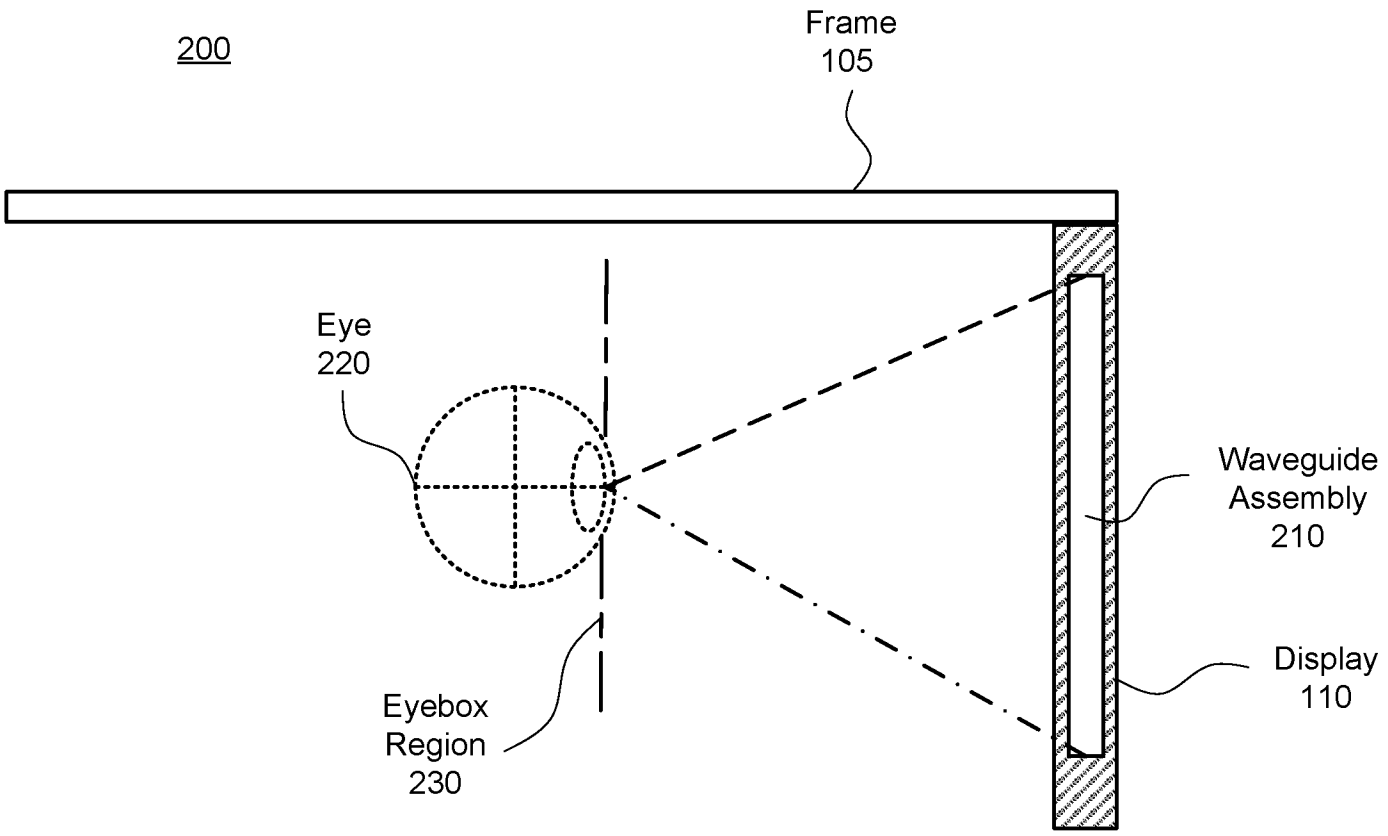
FIG. 2 is a cross-section of an eyewear of the NED illustrated in FIG. 1, in accordance with an embodiment.

FIG. 2 is a cross section 200 of the NED 100 illustrated in FIG. 1, in accordance with an embodiment. The cross section 200 illustrates at least one waveguide assembly 210. An exit pupil is a location where the eye 220 is positioned in an eyebox region 230 when the user wears the NED 100. In some embodiments, the frame 105 may represent a frame of eye-wear glasses. For purposes of illustration, FIG. 2 shows the cross section 200 associated with a single eye 220 and a single waveguide assembly 210, but in alternative embodiments not shown, another waveguide assembly which is separate from the waveguide assembly 210 shown in FIG. 2, provides image light to another eye 220 of the user.

The waveguide assembly 210, as illustrated below in FIG. 2, directs the image light to the eye 220 through the exit pupil. The waveguide assembly 210 may be composed of one or more materials (e.g., plastic, glass, etc.) with one or more refractive indices that effectively minimize the weight and widen a field of view (hereinafter abbreviated as 'FOV') of the NED 100. In alternate configurations, the NED 100 includes one or more optical elements between the waveguide assembly 210 and the eye 220. The optical elements may act (e.g., correct aberrations in image light emitted from the waveguide assembly 210) to magnify image light emitted from the waveguide assembly 210, some other optical adjustment of image light emitted from the waveguide assembly 210, or some combination thereof. The example for optical elements may include an aperture, a Fresnel lens, a convex lens, a concave lens, a filter, or any other suitable optical element that affects image light. In one embodiment, the waveguide assembly 210 may produce and direct many pupil replications to the eyebox region 230, in a manner that will be discussed in further detail below in association with FIG. 5B.

Figure 3A:
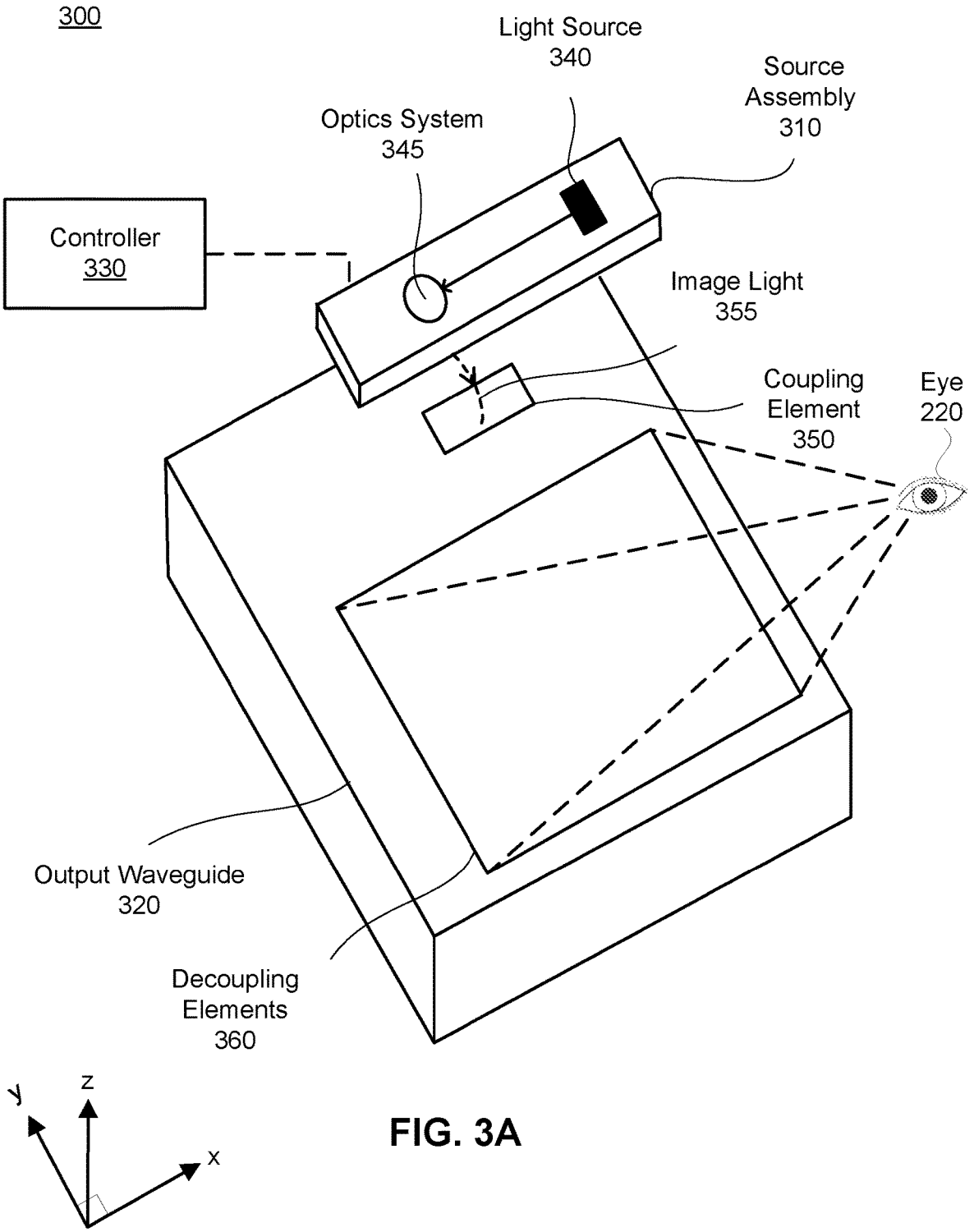
FIG. 3A is a perspective view of a display device, in accordance with an embodiment.

FIG. 3A illustrates a perspective view of a display device 300, in accordance with an embodiment. In some embodiments, the display device 300 is a component (e.g., the waveguide assembly 210 or part of the waveguide assembly 210) of the NED 100. In alternative embodiments, the display device 300 is part of some other NEDs, or another system that directs display image light to a particular location. Depending on embodiments and implementations, the display device 300 may also be referred to as a waveguide display and/or a scanning display. However, in other embodiment, the display device 300 does not include a scanning mirror. For example, the display device 300 can include matrices of light emitters that project light on an image field through a waveguide but without a scanning mirror. In another embodiment, the image emitted by the two-dimensional matrix of light emitters may be magnified by an optical assembly (e.g., lens) before the light arrives a waveguide or a screen.

For a particular embodiment that uses a waveguide and an optical system, the display device 300 may include a source assembly 310, an output waveguide 320, and a controller 330. The display device 300 may provide images for both eyes or for a single eye. For purposes of illustration, FIG. 3A shows the display device 300 associated with a single eye 220. Another display device (not shown), separated (or partially separated) from the display device 300, provides image light to another eye of the user. In a partially separated system, one or more components may be shared between display devices for each eye.

The source assembly 310 generates image light 355. The source assembly 310 includes a light source 340 and an optics system 345. The light source 340 is an optical component that generates image light using a plurality of light emitters arranged in a matrix. Each light emitter may emit monochromatic light. The light source 340 generates image light including, but not restricted to, Red image light, Blue image light, Green image light, infra-red image light, etc. While RGB is often discussed in this disclosure, embodiments described herein are not limited to using red, blue and green as primary colors. Other colors are also possible to be used as the primary colors of the display device. Also, a display device in accordance with an embodiment may use more than three primary colors.

The optics system 345 performs a set of optical processes, including, but not restricted to, focusing, combining, conditioning, and scanning processes on the image light generated by the light source 340. In some embodiments, the optics system 345 includes a combining assembly, a light conditioning assembly, and a scanning mirror assembly, as described below in detail in conjunction with FIG. 3B. The source assembly 310 generates and outputs an image light 355 to a coupling element 350 of the output waveguide 320.

The output waveguide 320 is an optical waveguide that outputs image light to an eye 220 of a user. The output waveguide 320 receives the image light 355 at one or more coupling elements 350, and guides the received input image light to one or more decoupling elements 360. The coupling element 350 may be, e.g., a diffraction grating, a holographic grating, some other element that couples the image light 355 into the output waveguide 320, or some combination thereof. For example, in embodiments where the coupling element 350 is diffraction grating, the pitch of the diffraction grating is chosen such that total internal reflection occurs, and the image light 355 propagates internally toward the decoupling element 360. The pitch of the diffraction grating may be in the range of 300 nm to 600 nm.

The decoupling element 360 decouples the total internally reflected image light from the output waveguide 320. The decoupling element 360 may be, e.g., a diffraction grating, a holographic grating, some other element that decouples image light out of the output waveguide 320, or some combination thereof. For example, in embodiments where the decoupling element 360 is a diffraction grating, the pitch of the diffraction grating is chosen to cause incident image light to exit the output waveguide 320. An orientation and position of the image light exiting from the output waveguide 320 are controlled by changing an orientation and position of the image light 355 entering the coupling element 350. The pitch of the diffraction grating may be in the range of 300 nm to 600 nm.

The output waveguide 320 may be composed of one or more materials that facilitate total internal reflection of the image light 355. The output waveguide 320 may be composed of e.g., silicon, plastic, glass, or polymers, or some combination thereof. The output waveguide 320 has a relatively small form factor. For example, the output waveguide 320 may be approximately 50 mm wide along X-dimension, 30 mm long along Y-dimension and 0.5-1 mm thick along Z-dimension.

The controller 330 controls the image rendering operations of the source assembly 310. The controller 330 determines instructions for the source assembly 310 based at least on the one or more display instructions. Display instructions are instructions to render one or more images. In some embodiments, display instructions may simply be an image file (e.g., bitmap). The display instructions may be received from, e.g., a console of a VR system (not shown here). Scanning instructions are instructions used by the source assembly 310 to generate image light 355. The scanning instructions may include, e.g., a type of a source of image light (e.g., monochromatic, polychromatic), a scanning rate, an orientation of a scanning apparatus, one or more illumination parameters, or some combination thereof. The controller 330 includes a combination of hardware, software, and/or firmware not shown here so as not to obscure other aspects of the disclosure.

Figure 3B:
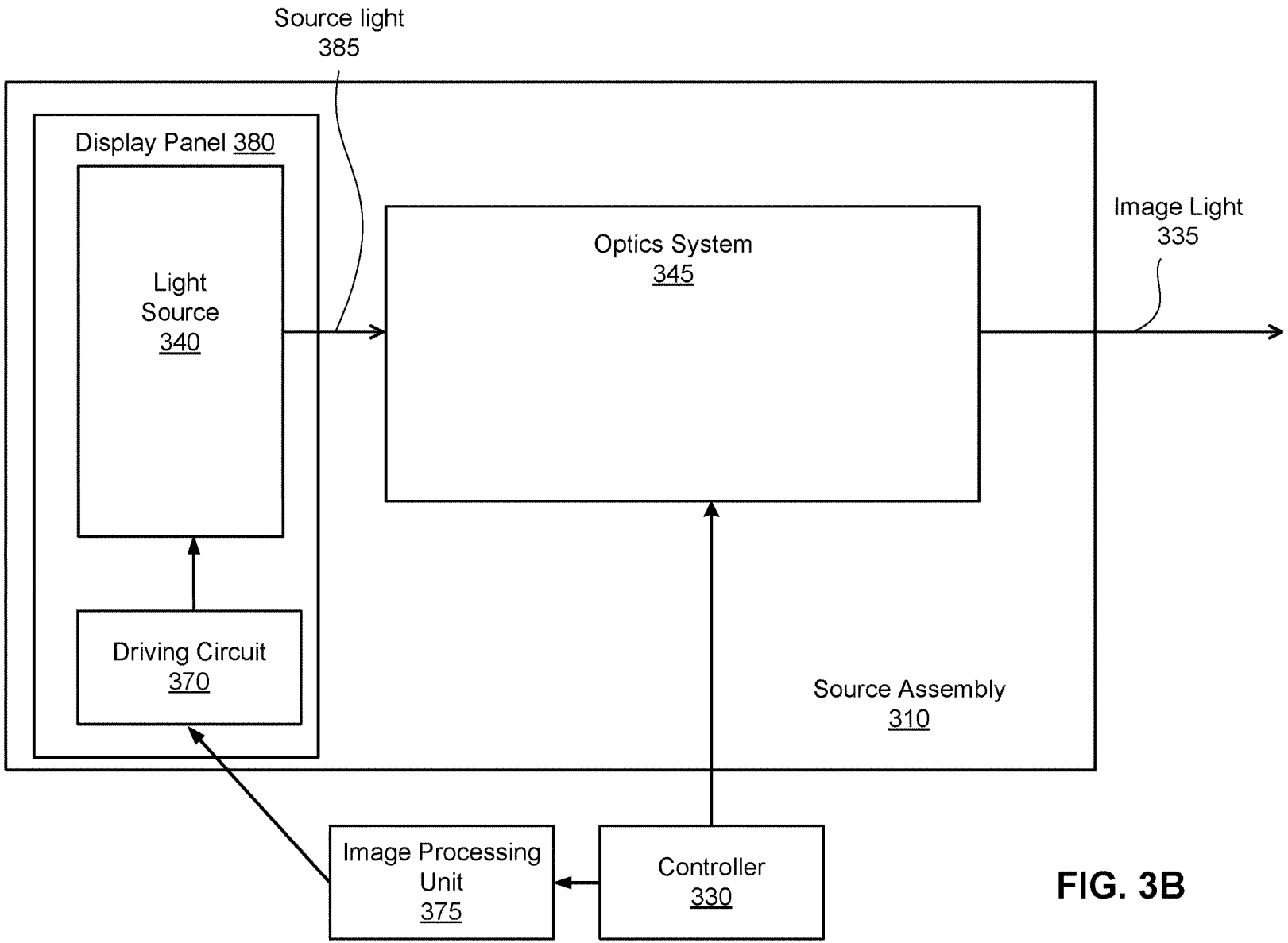
FIG. 3B illustrates a block diagram of a source assembly, in accordance with an embodiment.

FIG. 3B is a block diagram illustrating an example source assembly 310, in accordance with an embodiment. The source assembly 310 includes the light source 340 that emits light that is processed optically by the optics system 345 to generate image light 335 that will be projected on an image field (not shown). The light source 340 is driven by the driving circuit 370 based on the data sent from a controller 330 or an image processing unit 375. In one embodiment, the driving circuit 370 is the circuit panel that connects to and mechanically holds various light emitters of the light source 340. The driving circuit 370 and the light source 340 combined may sometimes be referred to as a display panel 380 or an LED panel (if some forms of LEDs are used as the light emitters).

The light source 340 may generate a spatially coherent or a partially spatially coherent image light. The light source 340 may include multiple light emitters. The light emitters can be vertical cavity surface emitting laser (VCSEL) devices, light emitting diodes (LEDs), microLEDs, tunable lasers, and/or some other light-emitting devices. In one embodiment, the light source 340 includes a matrix of light emitters. In another embodiment, the light source 340 includes multiple sets of light emitters with each set grouped by color and arranged in a matrix form. The light source 340 emits light in a visible band (e.g., from about 390 nm to 700 nm). The light source 340 emits light in accordance with one or more illumination parameters that are set by the controller 330 and potentially adjusted by image processing unit 375 and driving circuit 370. An illumination parameter is an instruction used by the light source 340 to generate light. An illumination parameter may include, e.g., source wavelength, pulse rate, pulse amplitude, beam type (continuous or pulsed), other parameter(s) that affect the emitted light, or some combination thereof. The light source 340 emits source light 385. In some embodiments, the source light 385 includes multiple beams of Red light, Green light, and Blue light, or some combination thereof.

The optics system 345 may include one or more optical components that optically adjust and potentially re-direct the light from the light source 340. One form of example adjustment of light may include conditioning the light. Conditioning the light from the light source 340 may include, e.g., expanding, collimating, correcting for one or more optical errors (e.g., field curvature, chromatic aberration, etc.), some other adjustment of the light, or some combination thereof. The optical components of the optics system 345 may include, e.g., lenses, mirrors, apertures, gratings, or some combination thereof. Light emitted from the optics system 345 is referred to as an image light 355.

The optics system 345 may redirect image light via its one or more reflective and/or refractive portions so that the image light 355 is projected at a particular orientation toward the output waveguide 320 (shown in FIG. 3A). Where the image light is redirected toward is based on specific orientations of the one or more reflective and/or refractive portions. In some embodiments, the optics system 345 includes a single scanning mirror that scans in at least two dimensions. In other embodiments, the optics system 345 may include a plurality of scanning mirrors that each scan in orthogonal directions to each other. The optics system 345 may perform a raster scan (horizontally, or vertically), a biresonant scan, or some combination thereof. In some embodiments, the optics system 345 may perform a controlled vibration along the horizontal and/or vertical directions with a specific frequency of oscillation to scan along two dimensions and generate a two-dimensional projected line image of the media presented to user's eyes. In other embodiments, the optics system 345 may also include a lens that serves similar or same function as one or more scanning mirror.

In some embodiments, the optics system 345 includes a galvanometer mirror. For example, the galvanometer mirror may represent any electromechanical instrument that indicates that it has sensed an electric current by deflecting a beam of image light with one or more mirrors. The galvanometer mirror may scan in at least one orthogonal dimension to generate the image light 355. The image light 355 from the galvanometer mirror represents a two-dimensional line image of the media presented to the user's eyes.

In some embodiments, the source assembly 310 does not include an optics system. The light emitted by the light source 340 is projected directly to the waveguide 320 (shown in FIG. 3A).

The controller 330 controls the operations of light source 340 and, in some cases, the optics system 345. In some embodiments, the controller 330 may be the graphics processing unit (GPU) of a display device. In other embodiments, the controller 330 may be other kinds of processors. The operations performed by the controller 330 includes taking content for display, and dividing the content into discrete sections. The controller 330 instructs the light source 340 to sequentially present the discrete sections using light emitters corresponding to a respective row in an image ultimately displayed to the user. The controller 330 instructs the optics system 345 to perform different adjustment of the light. For example, the controller 330 controls the optics system 345 to scan the presented discrete sections to different areas of a coupling element of the output waveguide 320 (shown in FIG. 3A). Accordingly, at the exit pupil of the output waveguide 320, each discrete portion is presented in a different location. While each discrete section is presented at different times, the presentation and scanning of the discrete sections occur fast enough such that a user's eye integrates the different sections into a single image or series of images. The controller 330 may also provide scanning instructions to the light source 340 that include an address corresponding to an individual source element of the light source 340 and/or an electrical bias applied to the individual source element.

The image processing unit 375 may be a general-purpose processor and/or one or more application-specific circuits that are dedicated to performing the features described herein. In one embodiment, a general-purpose processor may be coupled to a memory to execute software instructions that cause the processor to perform certain processes described herein. In another embodiment, the image processing unit 375 may be one or more circuits that are dedicated to performing certain features. While in FIG. 3B the image processing unit 375 is shown as a stand-alone unit that is separate from the controller 330 and the driving circuit 370, in other embodiments the image processing unit 375 may be a sub-unit of the controller 330 or the driving circuit 370. In other words, in those embodiments, the controller 330 or the driving circuit 370 performs various image processing procedures of the image processing unit 375. The image processing unit 375 may also be referred to as an image processing circuit.

Light Emitters

FIGS. 4A through 4E are conceptual diagrams that illustrate different light emitters' structure and arrangement, in accordance with various embodiments.

Figure 4A:
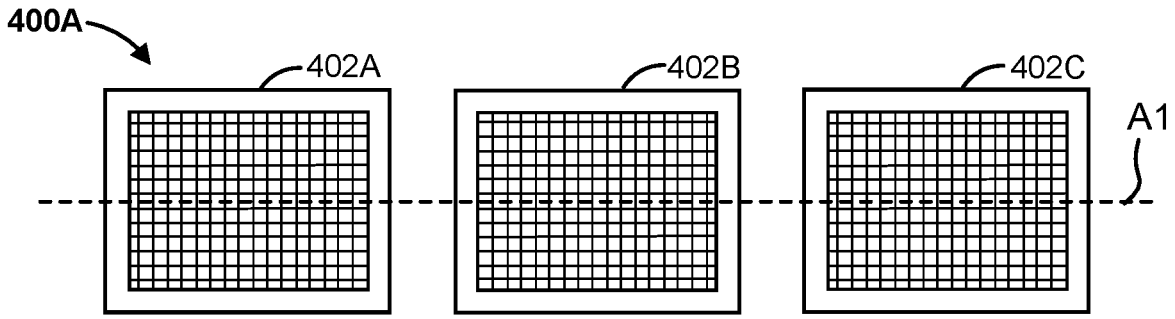
FIGS. 4A, 4B, and 4C are conceptual diagrams representing different arrangements of light emitters, in accordance with some embodiments.
Figure 4B:
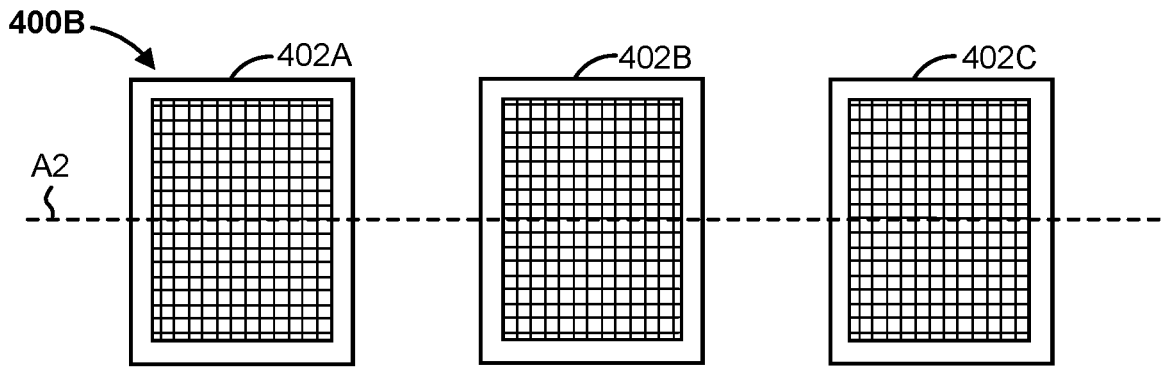
Figure 4C:
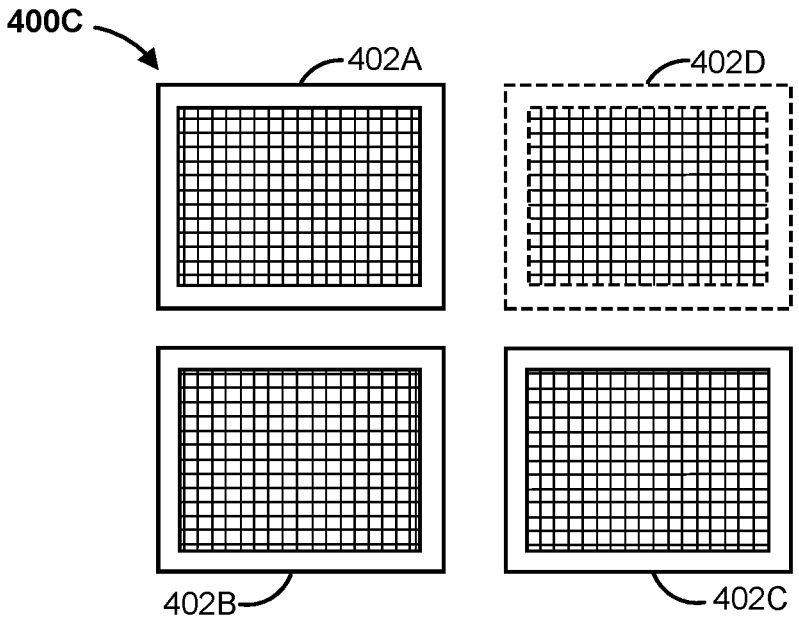

FIGS. 4A, 4B, and 4C are top views of matrix arrangement of light emitters' that may be included in the light source 340 of FIGS. 3A and 3B, in accordance to some embodiments. The configuration 400A shown in FIG. 4A is a linear configuration of the light emitter arrays 402A-C of FIG. 4A along the axis A1. This particular linear configuration may be arranged according to a longer side of the rectangular light emitter arrays 402. While the light emitter arrays 402 may have a square configuration of light emitters in some embodiments, other embodiments may include a rectangular configuration of light emitters. The light emitter arrays 402A-C each include multiple rows and columns of light emitters. Each light emitter array 402A-C may include light emitters of a single color. For example, light emitter array 402A may include red light emitters, light emitter array 402B may include green light emitters, and light emitter array 402C may include blue light emitters. In other embodiments, the light emitter arrays 402A-C may have other configurations (e.g., oval, circular, or otherwise rounded in some fashion) while defining a first dimension (e.g., a width) and a second dimension (e.g., length) orthogonal to the first direction, with one dimension being either equal or unequal to each other. In FIG. 4B, the light emitter arrays 402A-C may be disposed in a linear configuration 400B according to a shorter side of the rectangular light emitter arrays 402, along an axis A2. FIG. 4C shows a triangular configuration of the light emitter arrays 402A-C in which the centers of the light emitter arrays 402 form a non-linear (e.g., triangular) shape or configuration. Some embodiments of the configuration 400C of FIG. 4C may further include a white-light emitter array 402D, such that the light emitter arrays 402 are in a rectangular or square configuration. The light emitter arrays 402 may have a two-dimensional light emitter configuration with more than 1000 by 1000 light emitters, in some embodiments. Various other configurations are also within the scope of the present disclosure.

While the matrix arrangements of light emitters shown in FIGS. 4A-4C are arranged in perpendicular rows and columns, in other embodiments the matrix arrangements may be arranged other forms. For example, some of the light emitters may be aligned diagonally or in other arrangements, regular or irregular, symmetrical or asymmetrical. Also, the terms rows and columns may describe two relative spatial relationships of elements. While, for the purpose of simplicity, a column described herein is normally associated with a vertical line of elements, it should be understood that a column does not have to be arranged vertically (or longitudinally). Likewise, a row does not have to be arranged horizontally (or laterally). A row and a column may also sometimes describe an arrangement that is non-linear. Rows and columns also do not necessarily imply any parallel or perpendicular arrangement. Sometimes a row or a column may be referred to as a line. Also, in some embodiments, the light emitters may not be arranged in a matrix configuration. For example, in some display devices that include a rotating mirror that will be discussed in further details in FIG. 5A, there may be a single line of light emitters for each color. In other embodiments, there may be two or three lines of light emitters for each color.

Figure 4D:
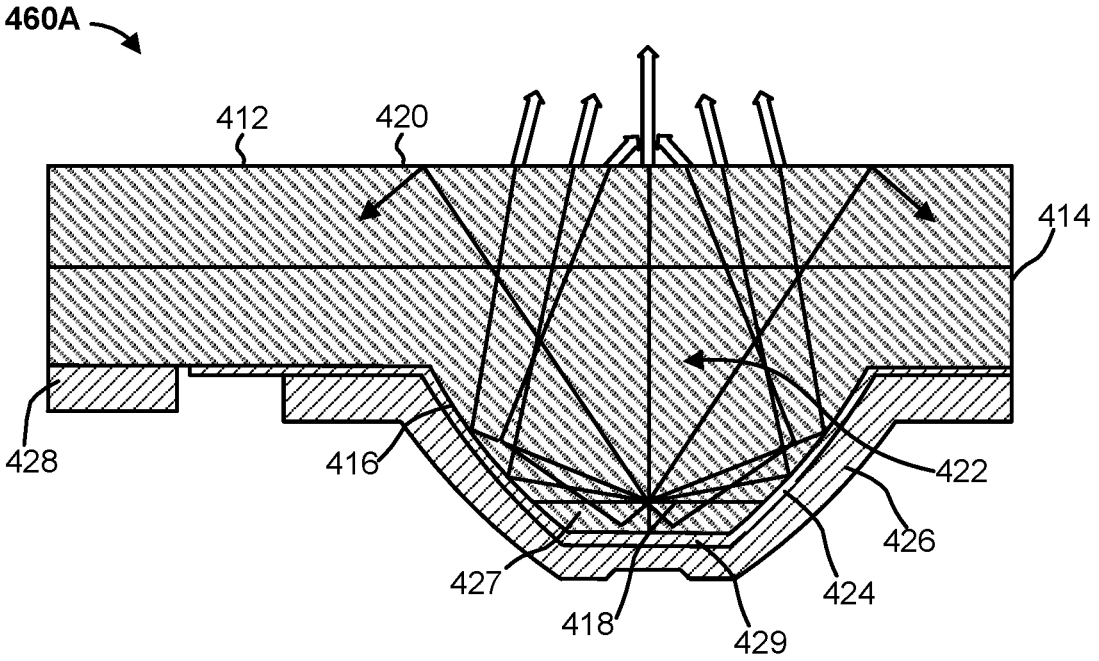
FIGS. 4D and 4E are schematic cross-sectional diagrams of light emitters, in accordance with some embodiments.
Figure 4E:
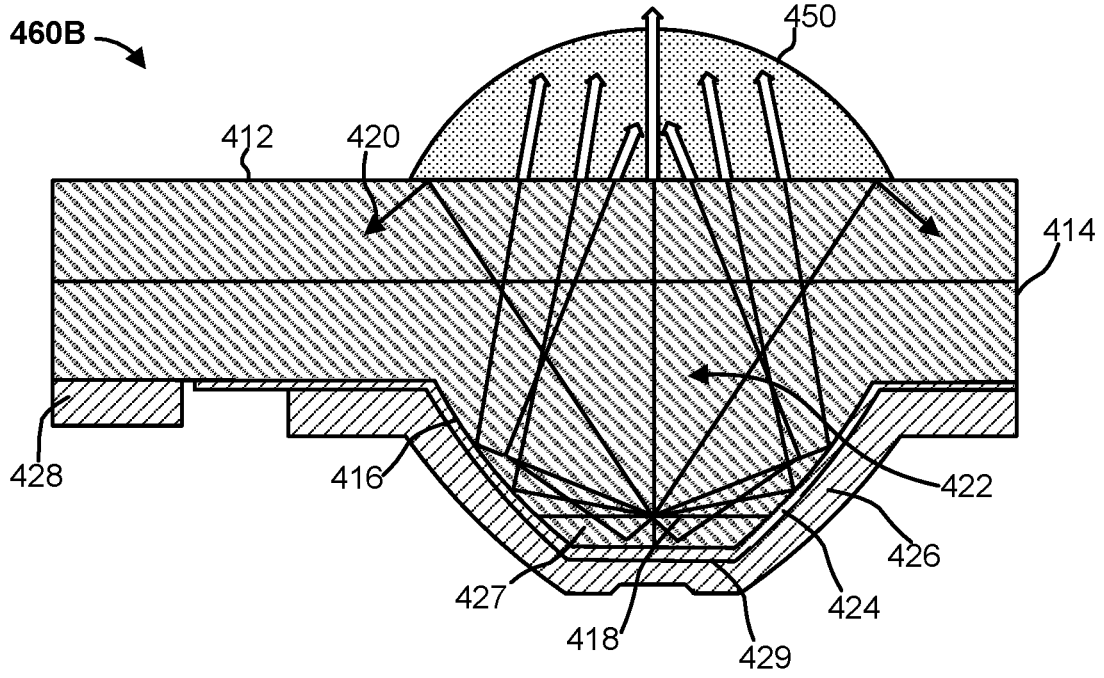

FIGS. 4D and 4E are schematic cross-sectional diagrams of an example of light emitters 410 that may be used as an individual light emitter in the light emitter arrays 402 of FIGS. 4A-C, in accordance with some embodiments. In one embodiment, the light emitter 410 may be microLED 460A. In other embodiments, other types of light emitters may be used. FIG. 4D shows a schematic cross-section of a microLED 460A. A "microLED" may be a particular type of LED having a small active light emitting area (e.g., less than 2,000 $\mu m^2$ in some embodiments, less than 20 $\mu m^2$ or less than 10 $\mu m^2$ in other embodiments). In some embodiments, the emissive surface of the microLED 460A may have a diameter of less than approximately 5 μm, although smaller (e.g., 2 μm) or larger diameters for the emissive surface may be utilized in other embodiments. The microLED 460A may also have collimated or non-Lambertian light output, in some examples, which may increase the brightness level of light emitted from a small active light-emitting area.

The microLED 460A may include, among other components, an LED substrate 412 with a semiconductor epitaxial layer 414 disposed on the substrate 412, a dielectric layer 424 and a p-contact 429 disposed on the epitaxial layer 414, a metal reflector layer 426 disposed on the dielectric layer 424 and p-contact 429, and an n-contact 428 disposed on the epitaxial layer 414. The epitaxial layer 414 may be shaped into a mesa 416. An active light-emitting area 418 may be formed in the structure of the mesa 416 by way of a p-doped region 427 of the epitaxial layer 414.

The substrate 412 may include transparent materials such as sapphire or glass. In one embodiment, the substrate 412 may include silicon, silicon oxide, silicon dioxide, aluminum oxide, sapphire, an alloy of silicon and germanium, indium phosphide (InP), and the like. In some embodiments, the substrate 412 may include a semiconductor material (e.g., monocrystalline silicon, germanium, silicon germanium (SiGe), and/or a III-V based material (e.g., gallium arsenide), or any combination thereof. In various embodiments, the substrate 412 can include a polymer-based substrate, glass, or any other bendable substrate including two-dimensional materials (e.g., graphene and molybdenum disulfide), organic materials (e.g., pentacene), transparent oxides (e.g., indium gallium zinc oxide (IGZO)), polycrystalline III-V materials, polycrystalline germanium, polycrystalline silicon, amorphous III-V materials, amorphous germanium, amorphous silicon, or any combination thereof. In some embodiments, the substrate 412 may include a III-V compound semiconductor of the same type as the active LED (e.g., gallium nitride). In other examples, the substrate 412 may include a material having a lattice constant close to that of the epitaxial layer 414.

The epitaxial layer 414 may include gallium nitride (GaN) or gallium arsenide (GaAs). The active layer 418 may include indium gallium nitride (InGaN). The type and structure of semiconductor material used may vary to produce microLEDs that emit specific colors. In one embodiment, the semiconductor materials used can include a III-V semiconductor material. III-V semiconductor material layers can include those materials that are formed by combining group III elements (Al, Ga, In, etc.) with group V elements (N, P, As, Sb, etc.). The p-contact 429 and n-contact 428 may be contact layers formed from indium tin oxide (ITO) or another conductive material that can be transparent at the desired thickness or arrayed in a grid-like pattern to provide for both good optical transmission/transparency and electrical contact, which may result in the microLED 460A also being transparent or substantially transparent. In such examples, the metal reflector layer 426 may be omitted. In other embodiments, the p-contact 429 and the n-contact 428 may include contact layers formed from conductive material (e.g., metals) that may not be optically transmissive or transparent, depending on pixel design.

In some implementations, alternatives to ITO can be used, including wider-spectrum transparent conductive oxides (TCOs), conductive polymers, metal grids, carbon nanotubes (CNT), graphene, nanowire meshes, and thin-metal films. Additional TCOs can include doped binary compounds, such as aluminum-doped zinc-oxide (AZO) and indium-doped cadmium-oxide. Additional TCOs may include barium stannate and metal oxides, such as strontium vanadate and calcium vanadate. In some implementations, conductive polymers can be used. For example, a poly(3,4-ethylenedioxythiophene) PEDOT: poly(styrene sulfonate) PSS layer can be used. In another example, a poly(4,4-dioctyl cyclopentadithiophene) material doped with iodine or 2,3-dichloro-5,6-dicyano-1,4-benzoquinone (DDQ) can be used. The example polymers and similar materials can be spin-coated in some example embodiments.

In some embodiments, the p-contact 429 may be of a material that forms an ohmic contact with the p-doped region 427 of the mesa 416. Examiner of such materials may include, but are not limited to, palladium, nickel oxide deposited as a NiAu multilayer coating with subsequent oxidation and annealing, silver, nickel oxide/silver, gold/zinc, platinum gold, or other combinations that form ohmic contacts with p-doped III-V semiconductor material.

The mesa 416 of the epitaxial layer 414 may have a truncated top on a side opposed to a substrate light emissive surface 420 of the substrate 412. The mesa 416 may also have a parabolic or near-parabolic shape to form a reflective enclosure or parabolic reflector for light generated within the microLED 460A. However, while FIG. 4D depicts a parabolic or near-parabolic shape for the mesa 416, other shapes for the mesa 416 are possible in other embodiments. The arrows indicate how light 422 emitted from the active layer 418 may be reflected off the internal walls of the mesa 416 toward the light emissive surface 420 at an angle sufficient for the light to escape the microLED 460A (i.e., outside an angle of total internal reflection). The p-contact 429 and the n-contact 428 may electrically connect the microLED 460A to a substrate.

The parabolic-shaped structure of the microLED 460A may result in an increase in the extraction efficiency of the microLED 460A into low illumination angles when compared to unshaped or standard LEDs. Standard LED dies may generally provide an emission full width at half maximum (FWHM) angle of 120°. In comparison, the microLED 460A can be designed to provide controlled emission angle FWHM of less than standard LED dies, such as around 41°. This increased efficiency and collimated output of the microLED 460A can enable improvement in overall power efficiency of the NED, which can be important for thermal management and/or battery life.

The microLED 460A may include a circular cross-section when cut along a horizontal plane, as shown in FIG. 4D. However, the microLED 460A cross-section may be non-circular in other examples. The microLED 460A may have a parabolic structure etched directly onto the LED die during the wafer processing steps. The parabolic structure may include the active light-emitting area 418 of the microLED 460A to generate light, and the parabolic structure may reflect a portion of the generated light to form the quasi-collimated light 422 emitted from the substrate light emissive surface 420. In some examples, the optical size of the microLED 460A may be smaller than or equal to the active light-emitting area 418. In other embodiments, the optical size of the microLED 460A may be larger than the active light-emitting area 418, such as through a refractive or reflective approach, to improve usable brightness of the microLED 460A, including any chief ray angle (CRA) offsets to be produced by the light emitter array 402.

FIG. 4E depicts a microLED 460B that is similar in many respects to the microLED 460A of FIG. 4D. The microLED 460B may further include a microlens 450, which may be formed over the parabolic structure. In some embodiments, the microlens 450 may be formed by applying a polymer coating over the microLED 460A, patterning the coating, and reflowing the coating to achieve the desired lens curvature. The microlens 450 may be disposed over an emissive surface to alter a chief ray angle of the microLED 460B. In another embodiment, the microlens 450 may be formed by depositing a microlens material above the microLED 460A (for example, by a spin-on method or a deposition process). For example, a microlens template (not shown) having a curved upper surface can be patterned above the microlens material. In some embodiments, the microlens template may include a photoresist material exposed using a distributing exposing light dose (e.g., for a negative photoresist, more light is exposed at a bottom of the curvature and less light is exposed at a top of the curvature), developed, and baked to form a rounding shape. The microlens 450 can then be formed by selectively etching the microlens material according to the microlens template. In some embodiments, the shape of the microlens 450 may be formed by etching into the substrate 412. In other embodiments, other types of light-shaping or light-distributing elements, such as an annular lens, Fresnel lens, or photonic crystal structures, may be used instead of microlenses.

In some embodiments, microLED arrangements other than those specifically discussed above in conjunction with FIGS. 4D and 4E may be employed as a microLED in light emitter array 402. For example, the microLED may include isolated pillars of epitaxially grown light-emitting material surrounded by a metal reflector. The pixels of the light emitter array 402 may also include clusters of small pillars (e.g., nanowires) of epitaxially grown material that may or may not be surrounded by reflecting material or absorbing material to prevent optical crosstalk. In some examples, the microLED pixels may be individual metal p-contacts on a planar, epitaxially grown LED device, in which the individual pixels may be electrically isolated using passivation means, such as plasma treatment, ion-implantation, or the like. Such devices may be fabricated with light extraction enhancement methods, such as microlenses, diffractive structures, or photonic crystals. Other processes for fabricating the microLEDs of the dimensions noted above other than those specifically disclosed herein may be employed in other embodiments.

Formation of an Image

Figure 5A:
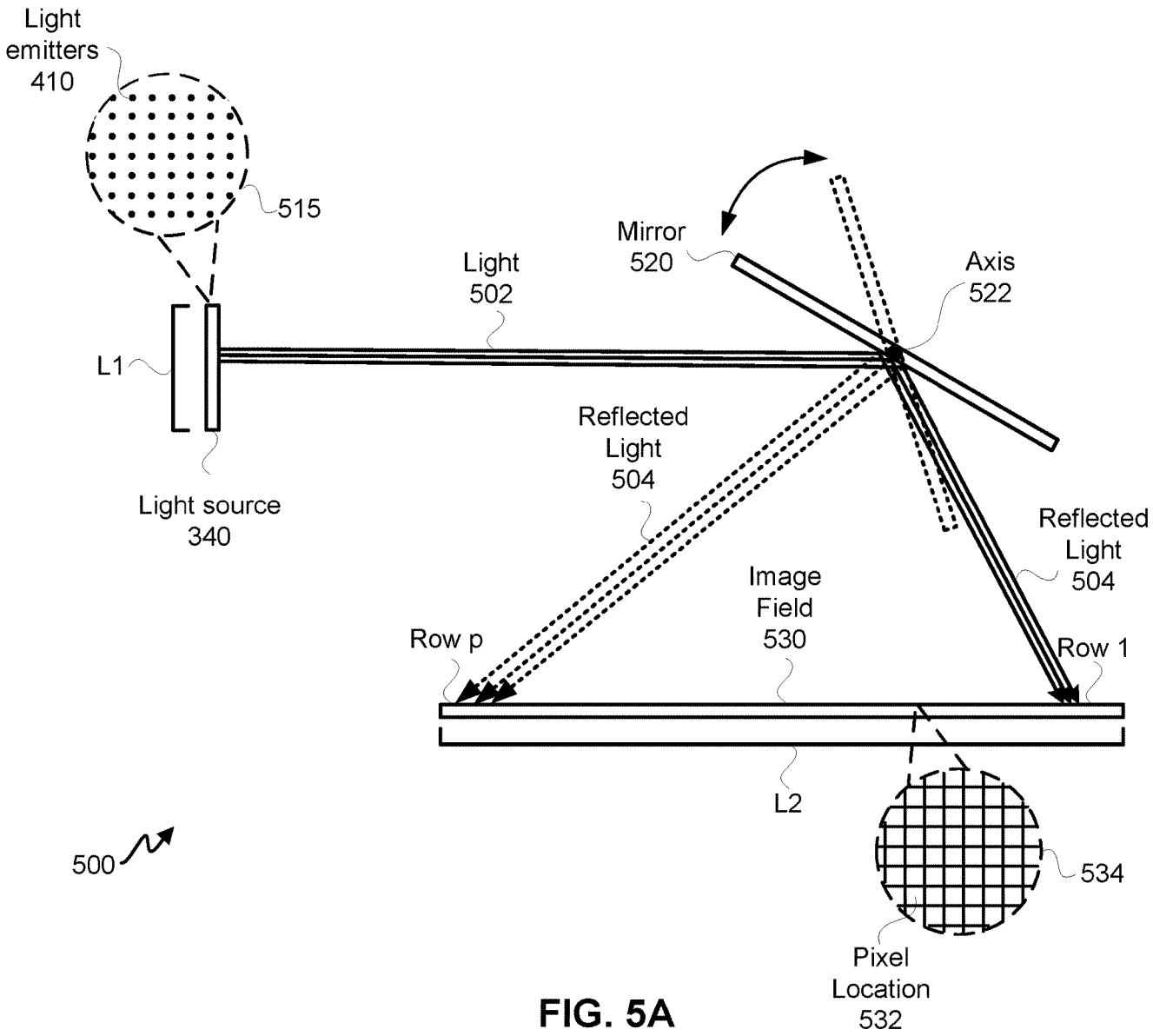
FIG. 5A is a diagram illustrating a scanning operation of a display device using a mirror to project light from a light source to an image field, in accordance with an embodiment.
Figure 5B:
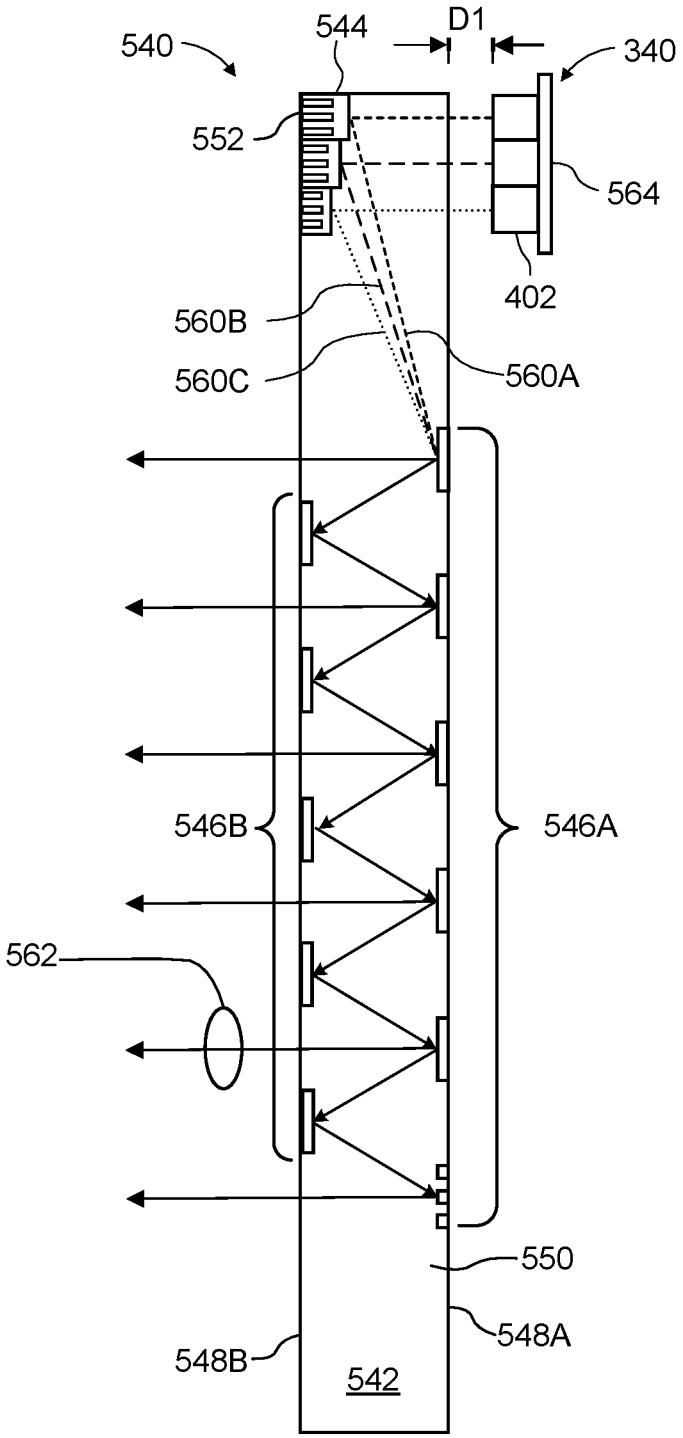
FIG. 5B is a diagram illustrating a waveguide configuration, in accordance with an embodiment.

FIGS. 5A and 5B illustrate how images and pupil replications are formed in a display device based on different structural arrangement of light emitters, in accordance with different embodiments. An image field is an area that receives the light emitted by the light source and forms an image. For example, an image field may correspond to a portion of the coupling element 350 or a portion of the decoupling element 360 in FIG. 3A. In some cases, an image field is not an actual physical structure but is an area to which the image light is projected and which the image is formed. In one embodiment, the image field is a surface of the coupling element 350 and the image formed on the image field is magnified as light travels through the output waveguide 320. In another embodiment, an image field is formed after light passing through the waveguide which combines the light of different colors to form the image field. In some embodiments, the image field may be projected directly into the user's eyes.

FIG. 5A is a diagram illustrating a scanning operation of a display device 500 using a scanning mirror 520 to project light from a light source 340 to an image field 530, in accordance with an embodiment. The display device 500 may correspond to the near-eye display 100 or another scan-type display device. The light source 340 may correspond to the light source 340 shown in FIG. 3B, or may be used in other display devices. The light source 340 includes multiple rows and columns of light emitters 410, as represented by the dots in inset 515. In one embodiment, the light source 340 may include a single line of light emitters 410 for each color. In other embodiments, the light source 340 may include more than one lines of light emitters 410 for each color. The light 502 emitted by the light source 340 may be a set of collimated beams of light. For example, the light 502 in FIG. 5 shows multiple beams that are emitted by a column of light emitters 410. Before reaching the mirror 520, the light 502 may be conditioned by different optical devices such as the conditioning assembly 430 (shown in FIG. 3B but not shown in FIG. 5). The mirror 520 reflects and projects the light 502 from the light source 340 to the image field 530. The mirror 520 rotates about an axis 522. The mirror 520 may be a microelectromechanical system (MEMS) mirror or any other suitable mirror. The mirror 520 may be an embodiment of the optics system 345 in FIG. 3B or a part of the optics system 345. As the mirror 520 rotates, the light 502 is directed to a different part of the image field 530, as illustrated by the reflected part of the light 504 in solid lines and the reflected part of the light 504 in dash lines.

At a particular orientation of the mirror 520 (i.e., a particular rotational angle), the light emitters 410 illuminate a portion of the image field 530 (e.g., a particular subset of multiple pixel locations 532 on the image field 530). In one embodiment, the light emitters 410 are arranged and spaced such that a light beam from each light emitter 410 is projected on a corresponding pixel location 532. In another embodiment, small light emitters such as microLEDs are used for light emitters 410 so that light beams from a subset of multiple light emitters are together projected at the same pixel location 532. In other words, a subset of multiple light emitters 410 collectively illuminates a single pixel location 532 at a time.

The image field 530 may also be referred to as a scan field because, when the light 502 is projected to an area of the image field 530, the area of the image field 530 is being illuminated by the light 502. The image field 530 may be spatially defined by a matrix of pixel locations 532 (represented by the blocks in inset 534) in rows and columns. A pixel location here refers to a single pixel. The pixel locations 532 (or simply the pixels) in the image field 530 sometimes may not actually be additional physical structure. Instead, the pixel locations 532 may be spatial regions that divide the image field 530. Also, the sizes and locations of the pixel locations 532 may depend on the projection of the light 502 from the light source 340. For example, at a given angle of rotation of the mirror 520, light beams emitted from the light source 340 may fall on an area of the image field 530. As such, the sizes and locations of pixel locations 532 of the image field 530 may be defined based on the location of each light beam. In some cases, a pixel location 532 may be subdivided spatially into subpixels (not shown). For example, a pixel location 532 may include a Red subpixel, a Green subpixel, and a Blue subpixel. The Red subpixel corresponds to a location at which one or more Red light beams are projected, etc. When subpixels are present, the color of a pixel 532 is based on the temporal and/or spatial average of the subpixels.

The number of rows and columns of light emitters 410 of the light source 340 may or may not be the same as the number of rows and columns of the pixel locations 532 in the image field 530. In one embodiment, the number of light emitters 410 in a row is equal to the number of pixel locations 532 in a row of the image field 530 while the number of light emitters 410 in a column is two or more but fewer than the number of pixel locations 532 in a column of the image field 530. Put differently, in such embodiment, the light source 340 has the same number of columns of light emitters 410 as the number of columns of pixel locations 532 in the image field 530 but has fewer rows than the image field 530. For example, in one specific embodiment, the light source 340 has about 1280 columns of light emitters 410, which is the same as the number of columns of pixel locations 532 of the image field 530, but only a handful of light emitters 410. The light source 340 may have a first length L1, which is measured from the first row to the last row of light emitters 410. The image field 530 has a second length L2, which is measured from row 1 to row p of the scan field 530. In one embodiment, L2 is greater than L1 (e.g., L2 is 50 to 10,000 times greater than L1).

Since the number of rows of pixel locations 532 is larger than the number of rows of light emitters 410 in some embodiments, the display device 500 uses the mirror 520 to project the light 502 to different rows of pixels at different times. As the mirror 520 rotates and the light 502 scans through the image field 530 quickly, an image is formed on the image field 530. In some embodiments, the light source 340 also has a smaller number of columns than the image field 530. The mirror 520 can rotate in two dimensions to fill the image field 530 with light (e.g., a raster-type scanning down rows then moving to new columns in the image field 530).

The display device may operate in predefined display periods. A display period may correspond to a duration of time in which an image is formed. For example, a display period may be associated with the frame rate (e.g., a reciprocal of the frame rate). In the particular embodiment of display device 500 that includes a rotating mirror, the display period may also be referred to as a scanning period. A complete cycle of rotation of the mirror 520 may be referred to as a scanning period. A scanning period herein refers to a predetermined cycle time during which the entire image field 530 is completely scanned. The scanning of the image field 530 is controlled by the mirror 520. The light generation of the display device 500 may be synchronized with the rotation of the mirror 520. For example, in one embodiment, the movement of the mirror 520 from an initial position that projects light to row 1 of the image field 530, to the last position that projects light to row p of the image field 530, and then back to the initial position is equal to a scanning period. The scanning period may also be related to the frame rate of the display device 500. By completing a scanning period, an image (e.g., a frame) is formed on the image field 530 per scanning period. Hence, the frame rate may correspond to the number of scanning periods in a second.

As the mirror 520 rotates, light scans through the image field and images are formed. The actual color value and light intensity (brightness) of a given pixel location 532 may be an average of the color various light beams illuminating the pixel location during the scanning period. After completing a scanning period, the mirror 520 reverts back to the initial position to project light onto the first few rows of the image field 530 again, except that a new set of driving signals may be fed to the light emitters 410. The same process may be repeated as the mirror 520 rotates in cycles. As such, different images are formed in the scanning field 530 in different frames.

FIG. 5B is a conceptual diagram illustrating a waveguide configuration to form an image and replications of images that may be referred to as pupil replications, in accordance with an embodiment. In this embodiment, the light source of the display device may be separated into three different light emitter arrays 402, such as based on the configurations shown in FIGS. 4A and 4B. The primary colors may be red, green, and blue or another combination of other suitable primary colors. In one embodiment, the number of light emitters in each light emitter array 402 may be equal to the number of pixel locations an image field (not shown in FIG. 5B). As such, contrary to the embodiment shown in FIG. 5A that uses a scanning operation, each light emitter may be dedicated to generating images at a pixel location of the image field. In another embodiment, the configuration shown in FIGS. 5A and 5B may be combined. For example, the configuration shown in FIG. 5B may be located downstream of the configuration shown in FIG. 5A so that the image formed by the scanning operation in FIG. 5A may further be replicated to generate multiple replications.

The embodiments depicted in FIG. 5B may provide for the projection of many image replications (e.g., pupil replications) or decoupling a single image projection at a single point. Accordingly, additional embodiments of disclosed NEDs may provide for a single decoupling element. Outputting a single image toward the eyebox 230 may preserve the intensity of the coupled image light. Some embodiments that provide for decoupling at a single point may further provide for steering of the output image light. Such pupil-steering NEDs may further include systems for eye tracking to monitor a user's gaze. Some embodiments of the waveguide configurations that provide for pupil replication, as described herein, may provide for one-dimensional replication, while other embodiments may provide for two-dimensional replication. For simplicity, one-dimensional pupil replication is shown in FIG. 5B. Two-dimensional pupil replication may include directing light into and outside the plane of FIG. 5B. FIG. 5B is presented in a simplified format. The detected gaze of the user may be used to adjust the position and/or orientation of the light emitter arrays 402 individually or the light source 340 as a whole and/or to adjust the position and/or orientation of the waveguide configuration.

In FIG. 5B, a waveguide configuration 540 is disposed in cooperation with a light source 340, which may include one or more monochromatic light emitter arrays 402 secured to a support structure 564 (e.g., a printed circuit board or another structure). The support structure 564 may be coupled to the frame 105 of FIG. 1. The waveguide configuration 540 may be separated from the light source 340 by an air gap having a distance D1. The distance D1 may be in a range from approximately 50 μm to approximately 500 μm in some examples. The monochromatic image or images projected from the light source 340 may pass through the air gap toward the waveguide configuration 540. Any of the light source embodiments described herein may be utilized as the light source 340.

The waveguide configuration may include a waveguide 542, which may be formed from a glass or plastic material. The waveguide 542 may include a coupling area 544 and a decoupling area formed by decoupling elements 546A on a top surface 548A and decoupling elements 546B on a bottom surface 548B in some embodiments. The area within the waveguide 542 in between the decoupling elements 546A and 546B may be considered a propagation area 550, in which light images received from the light source 340 and coupled into the waveguide 542 by coupling elements included in the coupling area 544 may propagate laterally within the waveguide 542.

The coupling area 544 may include a coupling element 552 configured and dimensioned to couple light of a predetermined wavelength, e.g., red, green, or blue light. When a white light emitter array is included in the light source 340, the portion of the white light that falls in the predetermined wavelength may be coupled by each of the coupling elements 552. In some embodiments, the coupling elements 552 may be gratings, such as Bragg gratings, dimensioned to couple a predetermined wavelength of light. In some examples, the gratings of each coupling element 552 may exhibit a separation distance between gratings associated with the predetermined wavelength of light that the particular coupling element 552 is to couple into the waveguide 542, resulting in different grating separation distances for each coupling element 552. Accordingly, each coupling element 552 may couple a limited portion of the white light from the white light emitter array when included. In other examples, the grating separation distance may be the same for each coupling element 552. In some examples, coupling element 552 may be or include a multiplexed coupler.

As shown in FIG. 5B, a red image 560A, a blue image 560B, and a green image 560C may be coupled by the coupling elements of the coupling area 544 into the propagation area 550 and may begin traversing laterally within the waveguide 542. In one embodiment, the red image 560A, the blue image 560B, and the green image 560C, each represented by a different dash line in FIG. 5B, may converge to form an overall image that is represented by a solid line. For simplicity, FIG. 5B may show an image by a single arrow, but each arrow may represent an image field where the image is formed. In another embodiment, red image 560A, the blue image 560B, and the green image 560C, may correspond to different spatial locations.

A portion of the light may be projected out of the waveguide 542 after the light contacts the decoupling element 546A for one-dimensional pupil replication, and after the light contacts both the decoupling element 546A and the decoupling element 546B for two-dimensional pupil replication. In two-dimensional pupil replication embodiments, the light may be projected out of the waveguide 542 at locations where the pattern of the decoupling element 546A intersects the pattern of the decoupling element 546B.

The portion of light that is not projected out of the waveguide 542 by the decoupling element 546A may be reflected off the decoupling element 546B. The decoupling element 546B may reflect all incident light back toward the decoupling element 546A, as depicted. Accordingly, the waveguide 542 may combine the red image 560A, the blue image 560B, and the green image 560C into a polychromatic image instance, which may be referred to as a pupil replication 562. The polychromatic pupil replication 562 may be projected toward the eyebox 230 of FIG. 2 and to the eye 220, which may interpret the pupil replication 562 as a full-color image (e.g., an image including colors in addition to red, green, and blue). The waveguide 542 may produce tens or hundreds of pupil replications 562 or may produce a single replication 562.

In some embodiments, the waveguide configuration may differ from the configuration shown in FIG. 5B. For example, the coupling area may be different. Rather than including gratings as coupling element 552, an alternate embodiment may include a prism that reflects and refracts received image light, directing it toward the decoupling element 706A. Also, while FIG. 5B generally shows the light source 340 having multiple light emitters arrays 402 coupled to the same support structure 564, other embodiments may employ a light source 340 with separate monochromatic emitters arrays 402 located at disparate locations about the waveguide configuration (e.g., one or more emitters arrays 402 located near a top surface of the waveguide configuration and one or more emitters arrays 402 located near a bottom surface of the waveguide configuration).

Also, although only three light emitter arrays are shown in FIG. 5B, an embodiment may include more or fewer light emitter arrays. For example, in one embodiment, a display device may include two red arrays, two green arrays, and two blue arrays. In one case, the extra set of emitter panels provides redundant light emitters for the same pixel location. In another case, one set of red, green, and blue panels is responsible for generating light corresponding to the most significant bits of a color dataset for a pixel location while another set of panels is responsible for generating light corresponding the least significant bits of the color dataset. The separation of most and least significant bits of a color dataset will be discussed in further detail below in FIG. 6.

While FIGS. 5A and 5B show different ways an image may be formed in a display device, the configurations shown in FIGS. 5A and 5B are not mutually exclusive. For example, in one embodiment, a display device may use both a rotating mirror and a waveguide to form an image and also to form multiple pupil replications.

Figure 5C:
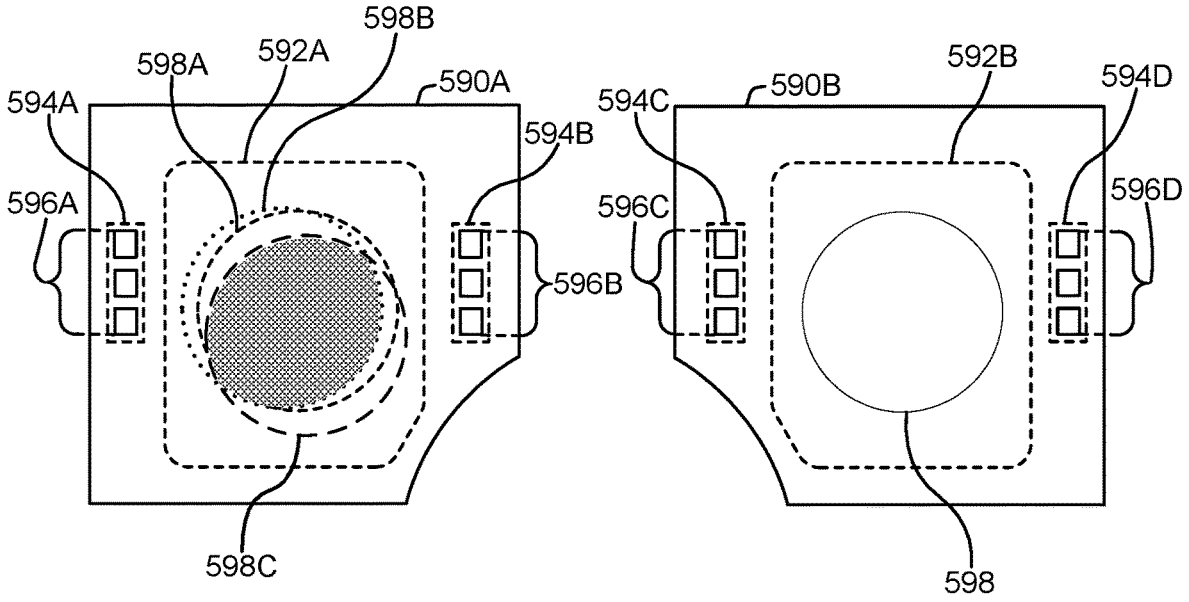
FIG. 5C is a top view of display device, in accordance with an embodiment.

FIG. 5C is a top view of a display system (e.g., an NED), in accordance with an embodiment. The NED 570 in FIG. 9A may include a pair of waveguide configurations. Each waveguide configuration projects images to an eye of a user. In some embodiments not shown in FIG. 5C, a single waveguide configuration that is sufficiently wide to project images to both eyes may be used. The waveguide configurations 590A and 590B may each include a decoupling area 592A or 592B. In order to provide images to an eye of the user through the waveguide configuration 590, multiple coupling areas 594 may be provided in a top surface of the waveguide of the waveguide configuration 590. The coupling areas 594A and 594B may include multiple coupling elements to interface with light images provided by a light emitter array set 596A and a light emitter array set 596B, respectively. Each of the light emitter array sets 596 may include a plurality of monochromatic light emitter arrays, as described herein. As shown, the light emitter array sets 596 may each include a red light emitter array, a green light emitter array, and a blue light emitter array. As described herein, some light emitter array sets may further include a white light emitter array or a light emitter array emitting some other color or combination of colors.

The right eye waveguide 590A may include one or more coupling areas 594A, 594B, 594C, and 594D (all or a portion of which may be referred to collectively as coupling areas 594) and a corresponding number of light emitter array sets 596A, 596B, 596C, and 596D (all or a portion of which may be referred to collectively as the light emitter array sets 596). Accordingly, while the depicted embodiment of the right eye waveguide 590A may include two coupling areas 594 and two light emitter array sets 596, other embodiments may include more or fewer. In some embodiments, the individual light emitter arrays of a light emitter array set may be disposed at different locations around a decoupling area. For example, the light emitter array set 596A may include a red light emitter array disposed along a left side of the decoupling area 592A, a green light emitter array disposed along the top side of the decoupling area 592A, and a blue light emitter array disposed along the right side of the decoupling area 592A. Accordingly, light emitter arrays of a light emitter array set may be disposed all together, in pairs, or individually, relative to a decoupling area.

The left eye waveguide 590B may include the same number and configuration of coupling areas 594 and light emitter array sets 596 as the right eye waveguide 590A, in some embodiments. In other embodiments, the left eye waveguide 590B and the right eye waveguide 590A may include different numbers and configurations (e.g., positions and orientations) of coupling areas 594 and light emitter array sets 596. Included in the depiction of the left waveguide 590A and the right waveguide 590B are different possible arrangements of pupil replication areas of the individual light emitter arrays included in one light emitter array set 596. In one embodiment, the pupil replication areas formed from different color light emitters may occupy different areas, as shown in the left waveguide 590A. For example, a red light emitter array of the light emitter array set 596 may produce pupil replications of a red image within the limited area 598A. A green light emitter array may produce pupil replications of a green image within the limited area 598B. A blue light emitter array may produce pupil replications of a blue image within the limited area 598C. Because the limited areas 598 may be different from one monochromatic light emitter array to another, only the overlapping portions of the limited areas 598 may be able to provide full-color pupil replication, projected toward the eyebox 230. In another embodiment, the pupil replication areas formed from different color light emitters may occupy the same space, as represented by a single solid-lined circle 598 in the right waveguide 590B.

In one embodiment, waveguide portions 590A and 590B may be connected by a bridge waveguide (not shown). The bridge waveguide may permit light from the light emitter array set 596A to propagate from the waveguide portion 590A into the waveguide portion 590B. Similarly, the bridge waveguide may permit light emitted from the light emitter array set 596B to propagate from the waveguide portion 590B into the waveguide portion 590A. In some embodiments, the bridge waveguide portion may not include any decoupling elements, such that all light totally internally reflects within the waveguide portion. In other embodiments, the bridge waveguide portion 590C may include a decoupling area. In some embodiments, the bridge waveguide may be used to obtain light from both waveguide portions 590A and 590B and couple the obtained light to a detector (e.g. a photodetector), such as to detect image misalignment between the waveguide portions 590A and 590B.

Hybrid Pulse Width Modulation

Figure 6:
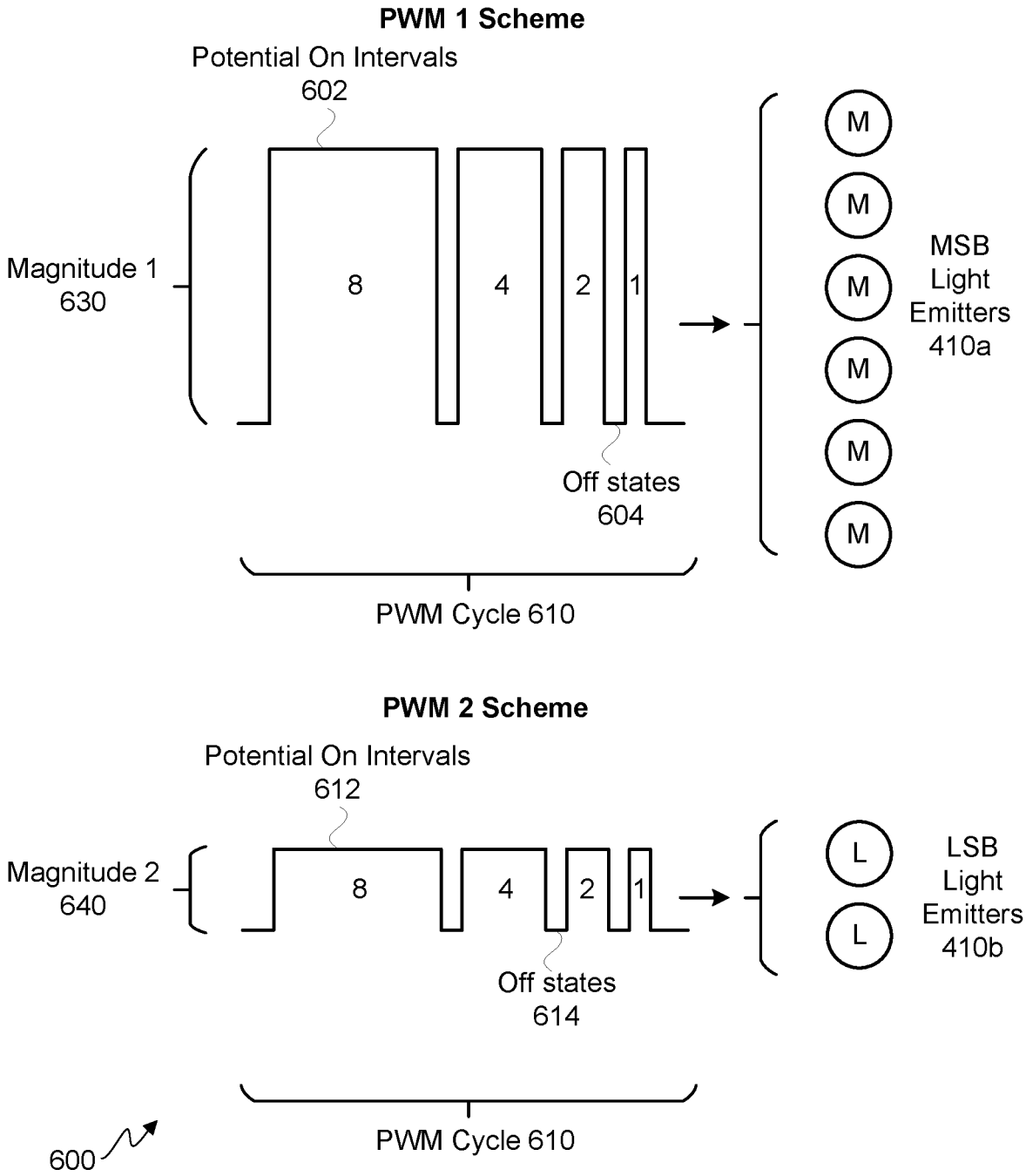
FIG. 6 is a conceptual diagram illustrating the pulse width modulations (PWMs) of driving signals that drive different light emitters of a display device, in accordance with an embodiment.

FIG. 6 is a conceptual diagram 600 illustrating operations of two or more light emitters using PWM schemes, in accordance with an embodiment. The MSB light emitters 410*a* and the LSB light emitters 410*b* collectively generate a desired color value. The MSB light emitters 410*a* and LSB light emitters 410*b* are driven by PWM signals. In a PWM cycle 610, there can be multiple discrete intervals of potential turn-on times. A turn-on time refers to a time interval in which current is supplied to a light emitter (i.e., when the light emitter is turned on). By the same token, an off-time or an off state refers to a time interval in which current is not supplied to a light emitter (i.e., when the light emitter is turned off). Whether a light emitter is really turned on in one of the potentially on-intervals 602 or 612 may depend on the actual bit value during the modulation. For example, if the actual bit value on which the modulation is based is 1001, the first and fourth potentially on-intervals are turned on and the second and third potentially on-intervals are turned off. In general, the larger the actual bit value represents, the longer is the turned-on times (i.e., more potentially on-intervals are turned on). The off states 604 and 614 are off intervals that respectively separate the potentially on-intervals 602 and the potentially on-intervals 612.

In a PWM cycle 610, there may be more than one potentially on-intervals and each potentially on-interval may be discrete (e.g., separated by an off state). Using PWM 1 modulation scheme in FIG. 6 as an example, the number of potentially on-intervals 602 may depend on the number bits in an MSB subset of bits on which the modulation is based. A color value (e.g., red=221) of an input pixel data may be represented in a binary form that has a number of bits. The bits are separated into two subsets. The first subset may correspond to a MSB subset. The number of potentially on-intervals 602 in a PWM cycle 610 may be equal to the number of bits in the MSB subset. For example, when the first 4 bits of an 8-bit input pixel data are classified as MSBs, there may be 4 potentially on-intervals 602, each separated by an off state 604, as shown in FIG. 6.

The lengths of the potentially on-intervals 602 within a PWM cycle 610 may be different but proportional to each other. For example, in the example shown in FIG. 6, which may correspond to an implementation for 8-bit input pixel data, the first potentially on-interval 602 has 8 units of length, the second potentially on-interval 602 has 4 units of length, the third potentially on-interval 602 has 2 units of length, and the last potentially on-interval 602 has 1 unit of length. Each potentially on-interval 602 may be driven by the same current level. The lengths of intervals in this type of 8-4-2-1 scheme correspond to the bits of the subset MSBs or LSBs. For example, for MSBs that have 4 bits, the first bit is twice more significant than the second bit, the second bit is twice more significant than the third bit, and the third bit is twice more significant than the last bit. In total, the first bit is 8 times more significant than the last bit. Hence, the 8-4-2-1 scheme reflects the differences in significance among the bits. The order of potential on-intervals 8-4-2-1 is for example only and does not have to be ascending or descending. For example, the order may also be 1-2-4-8 or 2-8-1-4, etc.

The levels of current driving the MSB light emitters 410*a* and driving the LSB light emitters 410*b* are different, as shown by the difference in magnitudes in the first magnitude 630 and the second magnitude 640. The MSB light emitters 410*a* and the LSB light emitters 410*b* are driven with different current levels because the MSB light emitters 410*a* represent bit values that are more significant than those of the LSB light emitters 410*b*. In one embodiment, the current level driving the LSB light emitters 410*b* is a fraction of the current level driving the MSB light emitters 410*a*. The fraction is proportional to a ratio between the number of MSB light emitters 410*a* and the number of LSB light emitters 410*b*. For example, in an implementation of 8-bit input pixel data that has the MSB light emitters 410*a* three times more than the LSB light emitters 410*b* (e.g., 6 MSB emitters and 2 LSB emitters), a scale factor of 3/16 may be used (3 is based on the ratio). As a result, the perceived light intensity (e.g., brightness) of the MSB light emitters for the potentially on-intervals corresponds to the set [8, 4, 2, 1], while the perceived light intensity of the LSB light emitters corresponds to the set [8, 4, 2, 1]*(⅓ of the number)*(3/16 scale factor)=[½, ¼, ⅛, 1/16]. As such, the total levels of greyscale under this scheme is 2 to the power of 8 (i.e., 256 levels of greyscale).

Since different current levels are used and two or more PWM schemes are used to drive the light emitters, the PWM schemes may be referred to as hybrid PWMs. For more information on how this type of hybrid PWMs are used to operate a display device, U.S. patent application Ser. No. 16/260,804, filed on Jan. 29, 2019, entitled "Hybrid Pulse Width Modulation for Display Device" is hereby incorporated by reference for all purposes.

Color Correction

Some types of light emitters are sensitive to the driving current level. For example, in a VR system such as an HMD or a NED 100, in order for the display to deliver a high resolution while maintaining a compact size, microLEDs might be used in as the light emitters 410. However, microLEDs exhibit color shifts with different driving current levels. For the same microLEDs that are supposed to emit light of the same wavelength, the change in driving current shifts the wavelength of the light generated by the microLEDs. For instance, in FIG. 6, even if the MSB light emitters 410*a* and the LSB light emitters 410*b* are identical microLEDs that are supposed to emit, for example, blue light of the same wavelength, the blue light emitted by the MSB light emitters 410*a* has a color shift compared to the blue light emitted by the LSB light emitters 410*b* because of the difference in driving current levels used in the two PWM schemes. This type of color shift is particularly severe in green and blue microLEDs.

Figure 7A:
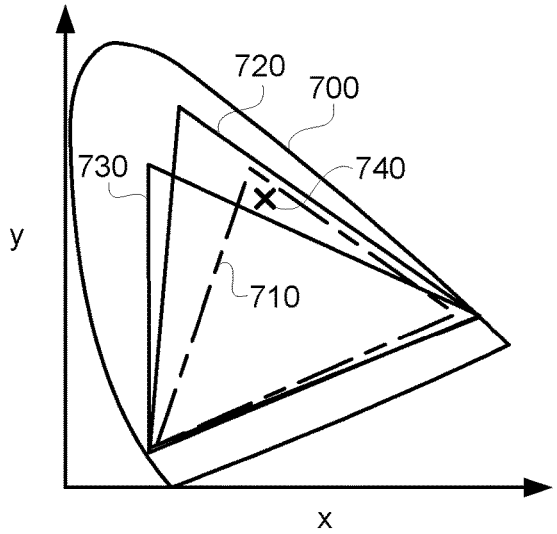
FIGS. 7A, 7B, and 7C are conceptual diagrams illustrating example color gamut regions in chromaticity diagrams.

FIG. 7A illustrates example color gamut regions shown in a CIE xy chromaticity diagram. The outer horseshoe-like shaped region 700 represents the range of all visible colors. The first color gamut 710, which is represented by a triangle in long-short dash lines in FIG. 7A, is the gamut for standard Red-Green-Blue (sRGB) color coordinate space. The sRGB color coordinate space is a standard color coordinate space that is widely used in many computers, printers, digital cameras, displays, etc. and is also used on the Internet to define color digitally. In order for a display device to be sufficiently versatile to display pixel data from various sources (e.g., images captured by digital cameras, video games, Internet web pages, etc.), the display device should be able to accurately display colors defined in the sRGB color coordinate space.

The second color gamut 720, which is represented by a solid lined triangle on the right in FIG. 7A, is the gamut generated by a display device using first light emitters that are driven by current at a first level. For example, the first light emitters can be a set of light emitters that include one or more red light emitters, one or more green light emitters, and one or more blue light emitters. In one case, the first light emitters may correspond to three sets of MSB light emitters 410*a* (e.g., 6 red MSB light emitters, 6 green MSB light emitters, and 6 blue MSB light emitters) shown in FIG. 6. The three types of color light emitters collectively define the color gamut 720.

The third color gamut 730, which is represented by a solid lined triangle on the left in FIG. 7A, is the gamut generated by the display device using second light emitters that are driven by current at a second level that is lower than the first level of current. Similar to the first light emitters, the second light emitters can be a set of one or more red, green, blue light emitters. In some cases, structurally the second light emitters are the same or substantially similar light emitters of the first light emitters (e.g., the red light emitter in the second set is structurally the same or substantially similar to the red light emitter in the first set, etc.). However, because the second light emitters are driven by a second PWM scheme that has a current level that is lower than the first PWM scheme, the second light emitters exhibit color shifts and result in a gamut 730 that does not completely overlap with the gamut 720 of the first light emitters. The second light emitters may correspond to the LSB light emitters 410*b* shown in FIG. 6 (e.g., 2 red LSB light emitters, 2 green LSB light emitters, and 2 blue LSB light emitters). In one embodiment, the MSB light emitters of different colors are driven by the same first level of current while the LSB light emitters of different colors are driven by the same second level of current that is lower than the first level. In another embodiment, the driving current levels for the MSB light emitters of different colors are different, but each driving current level for the MSB light emitters of a color is higher than that of the LSB light emitters of the corresponding color.

Owing to a failure to overlap in the gamut 720 and the gamut 730, using the same signal that is generated by the same color coordinate to drive both the first light emitters and the second light emitters will result in a mismatch of color. This is because the perceived color is a linear combination of three primary colors (three vertices in the triangle) in a gamut. Since the coordinates of the vertices of the gamut 720 and gamut 730 are not the same, the same linear combination of primary color values does not result in the same actual color for gamut 720 and gamut 730. The mismatch of color could result in contouring and other forms of visual artifacts in the display device.

FIG. 7A also includes a point 740 representing a color coordinate that is marked by a cross. The point 740 represents a color in the sRGB color coordinate space that is not within the common color gamut that is common to the gamut 720 and the gamut 730. For example, the point 740 shown in FIG. 7A is outside of the gamut 730. Without proper color correction, colors similar to the one represented by the point 740 could be problematic to a display device that uses the hybrid PWM schemes because the display device may not be able to properly deliver equivalent colors.

Figure 7B:
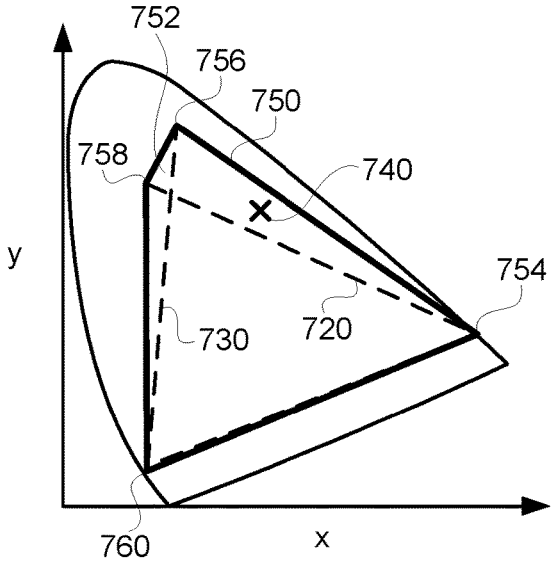

FIG. 7B illustrates an example color gamut 750 shown in the CIE xy chromaticity diagram, in accordance with an embodiment. The color gamut 750 is represented by a quadrilateral enclosed by a bolded solid line in FIG. 7B. The color gamut 750 represents the convex sum (e.g., a convex hull) of the vertices of the two triangular gamut regions 720 and 730 (corresponding to the gamut generated by the first light emitters and the gamut generated by the second light emitters), which are represented by dashed lines in FIG. 7B. The convex sum of the two triangular gamut regions 720 and 730 includes the union of the two gamut regions 720 and 730 and some extra regions such as region 752.

Colors in a display device are generated by an addition of primary colors (e.g., adding certain levels of red, green, blue light together) that correspond to the vertices of a polygon defining the gamut. As such, the quadrilateral gamut 750 involves four different primary colors to define the region. A display device generating the quadrilateral gamut 750 includes four primary light emitters that emit light of different wavelengths. Since the color shift in green light is most pronounced, the four primary colors that generate the quadrilateral gamut 750 are red, first green, second green, and blue, which are respectively represented by vertices 754, 756, 758, and 760. The first green 756 may correspond to light emitted by one or more green MSB light emitters while the second green 758 may correspond to light emitted by one or more green LSB light emitters.

Since the quadrilateral gamut 750 includes the union of the gamut 720 and gamut 730, the quadrilateral gamut 750 covers the entire region of sRGB gamut 710, as shown in FIG. 7A. Hence, a display device that uses the hybrid PWM schemes may use four primary color light emitters to generate the quadrilateral gamut 750 to address the issue of color shift. The colors in the quadrilateral gamut 750 can be expressed as linear combinations of the four primary colors.

Figure 7C:
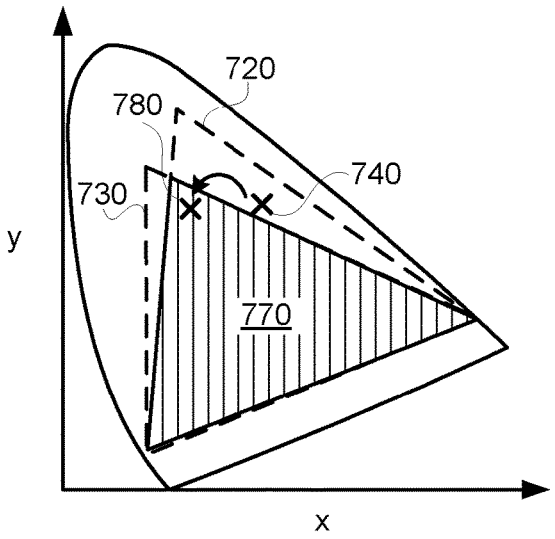

FIG. 7C illustrates another example color gamut 770 shown in the CIE xy chromaticity diagram, in accordance with an embodiment. The color gamut 770 is represented by a hashed triangle in FIG. 7C. The color gamut 770 represents a common color gamut that is common to the color gamut 720 (which corresponds to the first light emitters) and the color gamut 730 (which corresponds to the second light emitters). In other words, the color gamut 770 may be the intersection of the color gamut 720 and the color gamut 730. Since the color gamut 770 is shared by the color gamut 720 and color gamut 730, any light having a color coordinate that falls within the common color gamut 770 can be generated by the first light emitters and the second light emitters. A conversion can be made to convert an original color coordinate (such as the point 740) that is beyond the common color gamut 770 to an updated color coordinate (such as the point 780) that is within the common color gamut 770 according to a mapping scheme, such as a linear transformation operation or a predetermined look-up table. As such, input pixel data that represents a color value in an original color coordinate (such as a color coordinate in the sRGB color coordinate space) can be converted to an updated color coordinate that is within the common color gamut 770. The update color coordinate can be simply adjusted for the color gamut 720 and for the color gamut 730 for the respective generation of PWM signals and driving of the first light emitters and the second light emitters. This type of conversion process accounts for the color shift of the light emitters due to the differences in the driving current levels. Hence, color values in an original color coordinate space (such as sRGB) can be produced by a display device that uses the hybrid PWM schemes.

Figure 8A:
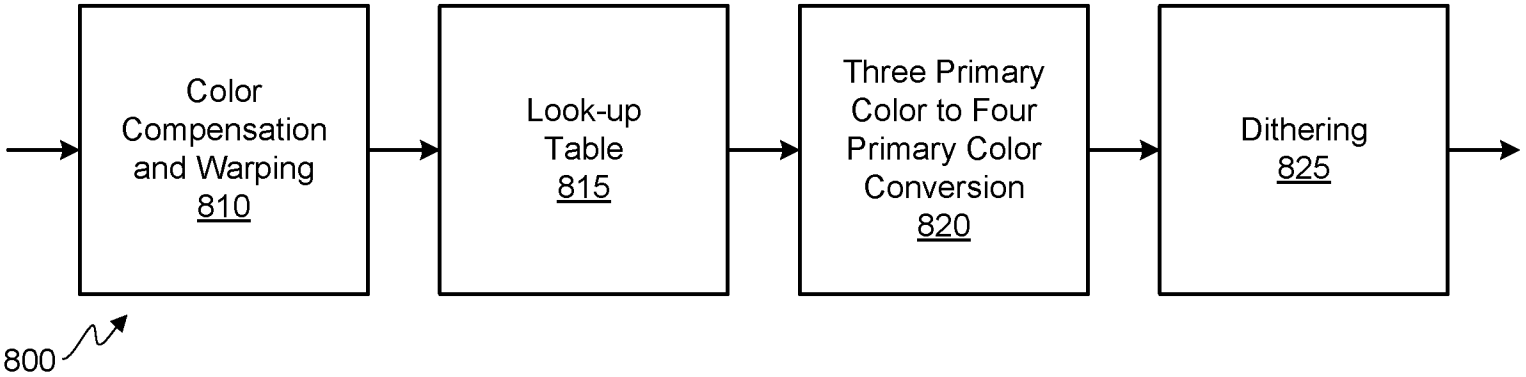
FIGS. 8A and 8B are block diagrams depicting different image processing operations, in accordance with some embodiments.

FIG. 8A illustrates an image processing operation 800 that is associated with processing pixel data for a display device with four basic color light emitters that generate a quadrilateral gamut 750 shown in FIG. 7B, in accordance with an embodiment. The image processing operation 800 may be performed by an image processing unit 375 shown in FIG. 3B. After receiving multiple sets of input pixel data (each set may correspond to a color value at a pixel location), the display device may perform color compensation and warping 810 to generate compensated pixel data. Color compensation and warping 810 may include various image processing for the perception of the human users. For example, color compensation may be performed based on user settings to make the images appear to be warmer, more vivid, more dynamic, etc. Color compensation and warping may also be performed to account for any curvature or other unique dimensions for HMD or NED 100 so that raw data of a flat image may appear more similar to the reality from the perception of the human users.

In the image processing operation 800, the compensated pixel data representing a color coordinate in a first color coordinate space (e.g., the RGB coordinate space) is then converted to an updated color coordinate by a look-up table 815. The updated color coordinate may be in a second color coordinate space such as the tristimulus values XYZ. Alternative to a look-up table, the conversion may also be done by a linear transformation operation. The display device then performs a conversion 820 to change three primary colors to four primary colors that include red, first green, second green, and blue. A dithering 825 may be performed to generate dithered pixel data. The dithering may be a vectorized dither operation that changes the bit depths of the pixel data (such as reducing the bit depths) and also accounts for any quantization imprecision in the pixel data. The dithering may be performed on all bits of red color (e.g., 8 bits red) and all bits of blue color (8 bits blue). The dithering may be separately performed on two green colors. For example, the first green color may correspond to the MSBs of the green color of the input pixel data (e.g., 4 bits MSB green) while the second green color may correspond to the LSBs of the green color of the input pixel data (e.g., 4 bits LSB green).

After dithering, the processed pixel data may be sent to a driving circuit (e.g., the driving circuit 370 shown in FIG. 3B) for the generation of PWM signals for various light emitters.

The image processing operation 800 associated with quadrilateral gamut 750 has certain advantages and disadvantages. One advantage is that the operation is the expanded gamut 750. Hence, any color in the quadrilateral gamut 750 can be expressed as a linear combination of four primary colors. However, the operation 800 requires extra processing and may sometimes be computationally challenging to achieve. For example, while in the example shown in FIG. 7B only green color is separated into two primary colors due to the significant color shift in green color, blue color and red color, which both also experience certain degrees of color shift, may also be separated into additional primary colors (e.g., having 5 or 6 primary colors). However, computation in various processes in the image processing operation 800 may be challenging when additional primary colors are added. Also, color compensation and warping 810 are often designed with only three primary colors. Hence, color compensation and warping 810 needs to be performed before three primary colors are converted to four primary colors. As a result, the primary color conversion and dithering for compensated pixel data may involve a very fast pixel clock. In addition, the multi-primary color dithering may also be associated with a significant overhead because the MSBs and the LSBs associated with the green colors are separately dithered.

Figure 8B:
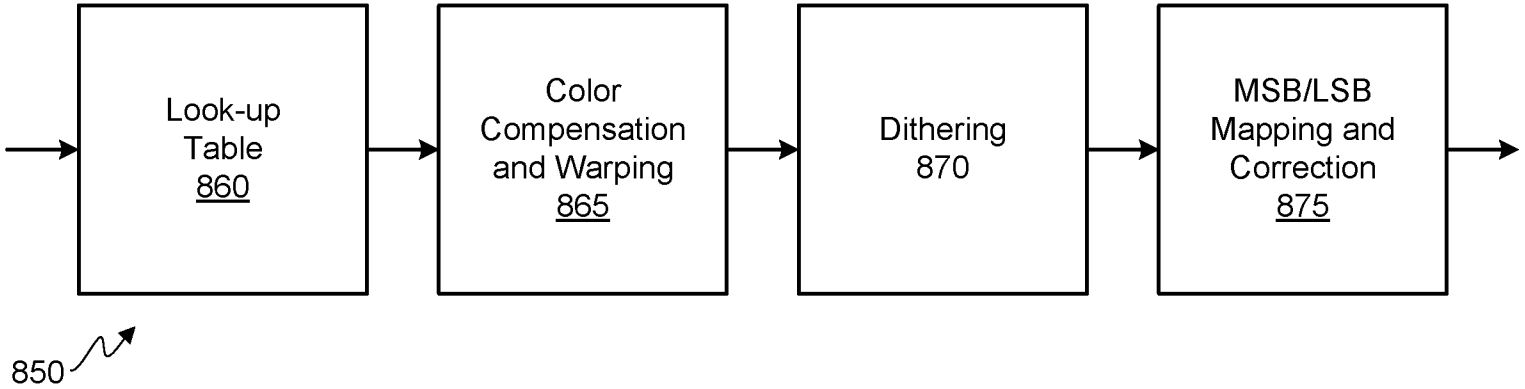

FIG. 8B illustrates another image processing operation 850 that is associated with processing pixel data for a display device that is associated with the common gamut 770 shown in FIG. 7C, in accordance with an embodiment. The image processing operation 850 may be performed by an image processing unit 375 shown in FIG. 3B. After receiving multiple sets of input pixel data (each set may correspond to a color value at a pixel location), the display device may convert the pixel data by a look-up table 860. For instance, the input pixel data represents an original color coordinate in a first color coordinate space (such as the RGB space) is converted to points within the common gamut 770. Hence, an original color coordinate that is beyond the common color gamut 770 is converted to an updated color coordinate within the common color gamut 770 according to a mapping scheme. The mapping scheme may be a transformation process that maps points in one gamut to another gamut. For example, the points in the sRGB gamut 710 in FIG. 7A may be mapped to the points in the common color gamut 770 in FIG. 7C (e.g., the transformation of point 740 to point 780) using a transformation process such as a linear transformation. The transformation may be performed under a constant-hue mapping operation. In other words, the transformation does not really change the perceived hue of the original color coordinate. The updated color coordinates may be in tristimulus values XYZ instead of RGB.

In one embodiment, the transformation process may be performed "on the fly." In other words, as input pixel data are received, a processor may use a stored transformation matrix to carry out a matrix multiplication to determine the updated color coordinates that are within the common gamut 770. In another embodiment, the transformation to a discrete number of values in the color space may be quantized and a look-up table 860 may be stored in a memory. In one embodiment, the look-up table 860 may be the same the look-up table 815 in the operation 800. The look-up table 860 may be a three-dimensional look-up table that includes calculated values of the matrix multiplication given different vectors of values of input color coordinates. For example, for a particular vector of RGB values, the look-up table 860 saves the answer of the matrix multiplication of the transformation matrix multiplying the vector. The look-up table 860 reduces the time for matrix multiplication "on the fly" and may speed up the conversion process.

The updated pixel data that includes the updated color coordinates may then undergo a color compensation and warping process 865 to generate compensated pixel data. The color compensation and warping process 865 may be similar to the color compensation and warping process 810. Hence, it may include various image processing for the perception of the human users. For example, color compensation may be performed based on user settings and/or to account for the dimensions of HMD or NED 100. Since the common gamut 770 is also a triangular gamut that is defined by three primary colors, the color compensation and warping process 865 can be performed after the conversion using the look-up table 860, unlike the operation 800.

The display device further processes the updated pixel data by dithering 870 to generate dithered pixel data. In the dithering 870, a version of the updated pixel data is used. The version may be the updated pixel data generated by the look-up table 860 (i.e., the output of block 860) or the compensated pixel data (i.e., the output of block 865) if compensation and/or warping is performed. Dithering 870 may be a vectorized dither operation that reduces the bit depths of the pixel data to match the capabilities of the light emitters. The The input pixel data is normally in the range of 8 to 10 bits, while the light emitters often are capable of displaying fewer bits. In one embodiment, unlike the image processing operation 800, the dithering 870 does not separate the color value into two separate green colors corresponding to the MSBs and LSBs. Hence, data processing is significantly simplified.

The display device also performs MSB/LSB mapping and correction 875 to the updated pixel data to generate two outputs, one for the MSB light emitters and another for the LSB light emitters. Again, the MSB/LSB mapping and correction 875 is performed on a version of the updated pixel data. The version may be updated pixel data generated by the look-up table 860, the compensated pixel data if compensation and/or warping 865 is performed, or the dithered pixel data if dithering 870 is performed.

The MSB/LSB mapping and correction 875 is a process that accounts for the color shift in the MSB light emitters and the LSB light emitters. In FIG. 7C, the MSB gamut 720 and the LSB gamut 730 do not completely overlap because of the color shift. Although a point (such as point 780) in the common gamut 770 is common to both gamut 720 and gamut 730, using the merely updated color coordinate associated within the common gamut 770 does not account for the color shift. This is because a perceived color is a linear combination of three RGB primary colors (represented by the vertices of a triangular gamut). Hence, the linear combination under the first gamut 720 and the linear combination of the same RGB value under the second gamut 730 do not corresponding to the same perceived color because the vertex locations are different.

To account for the differences, transformation processes are used to convert the updated color coordinate to a first output color coordinate that is within the first gamut 720 and to convert the same updated color coordinate to a second output color coordinate that is within the second gamut 730. In other words, a first output is generated to operate first light emitters to produce first light in accordance with the first color gamut 720. The generation of the first output color coordinate included in the first output is in accordance with the updated color coordinate in the updated pixel data but is fit for the first gamut 720. Likewise, a second output is generated to operate second light emitters to produce second light in accordance with the second color gamut 730. The generation of the second output color coordinate included in the second output is also in accordance with the updated color coordinate in the updated pixel data but is fit for the second gamut 730.

Each output color coordinate may include a set of RBG values (e.g., red=214, green=142, blue=023). The output color coordinate for the MSB light emitters is often different from the output color coordinate for the LSB light emitters because color shift is accounted. As such, the first light emitters and the second light emitters are made to agree by accounting for the color shift and correcting the output color coordinates. The output coordinates in the first output and the second output may be in RGB coordinates that can be applied in generating PWM signals.

In one embodiment, the MSB/LSB mapping and correction 875 is carried out by transformations such as linear transformations. For example, the updated color coordinate before the correction 875 can be multiplied by an MSB correction matrix to generate an output MBS color coordinate. Likewise, the same updated color coordinate can be multiplied by an LSB correction matrix to generate an output LSB color coordinate. The MSB correction matrix and LSB correction matrix account for the color shift respectively in MSB light emitters and LSB light emitters. The matrices may be different for different kinds light emitters and/or different driving current levels. In one case, the MSB correction matrix for 8-bit input data (4-bit MSBs, 4-bit LSBs) is the following:

$$\begin{bmatrix} R\ MSB \\ G\ MSB \\ B\ MSB \end{bmatrix} = \begin{bmatrix} 0.92 & .08 & 0 \\ 0 & 0.98 & 0.02 \\ 0 & 0 & 1 \end{bmatrix} \begin{bmatrix} R \\ G \\ B \end{bmatrix}$$

The LSB correction matrix for 8-bit input data (4-bit MSBs, 4-bit LSBs) is the following:

$$\begin{bmatrix} R\ LSB \\ G\ LSB \\ B\ LSB \end{bmatrix} = \begin{bmatrix} 0.99 & 0 & 0.01 \\ 0 & 1 & 0 \\ 0 & 0.17 & .83 \end{bmatrix} \begin{bmatrix} R \\ G \\ B \end{bmatrix}$$

In another case, the MSB correction matrix for 10-bit input data (5-bit MSBs, 5-bit LSBs) is the following:

$$\begin{bmatrix} R\ MSB \\ G\ MSB \\ B\ MSB \end{bmatrix} = \begin{bmatrix} 0.89 & .11 & 0 \\ 0 & 0.97 & 0.03 \\ 0 & 0 & 1 \end{bmatrix} \begin{bmatrix} R \\ G \\ B \end{bmatrix}$$

The LSB correction matrix for 10-bit input data (5-bit MSBs, 5-bit LSBs) is the following:

$$\begin{bmatrix} R\ LSB \\ G\ LSB \\ B\ LSB \end{bmatrix} = \begin{bmatrix} 0.99 & 0 & 0.01 \\ 0 & 1 & 0 \\ 0 & 0.18 & 0.82 \end{bmatrix} \begin{bmatrix} R \\ G \\ B \end{bmatrix}$$

After the two sets of output color coordinates are computed by the transformation, the output color coordinates may be used to create PWM signals to respectively drive the MSB and LSB light emitters. For example, red color coordinate of the MSB light emitters is converted to bits and the MSBs are extracted to generate a PWM signal for the red MSB light emitters, etc.

In some cases, before the output color coordinates are used, some adjustment may be made to the values of the color coordinates. For example, after the matrix multiplication, there may be a chance that the LSB would overflow. If so, the display devices may feed the overflowed value of LSB to MSB to account for the overflow. This can be achieved by an algorithm or by an equivalent lookup table.

By way of example, in one embodiment, the display device processes 8 bit data that has 4 bit LSB and 4 bit MSB with correction matrices $M_{MSB}$ and $M_{LSB}$. An 8 bit pixel vector (vector of RGB values) in the common color gamut (e.g., gamut 770) is denoted as p (e.g., updated color coordinate after look-up table 860). The MSB of vector p in the common color gamut may be defined as vector pMsB=16*floor(p/16). To transform the value of p into the MSB gamut (e.g., gamut 720), the output MSB vector may be a result of multiplying the correction matrix $M_{MSB}$ to the vector pMsB using the formula such as MSB=16*floor ($M_{MSB}$*$p_{MSB}$/16). However, because of a potential LSB overflow, the determined MSB at this point might only be an estimate of the correct output MSB. The determined MSB may be adjusted by using a correction vector denoted as $MSB_{correction}$. The correction vector is initially set at $[0\ 0\ 0]^T$, and can be determined by repeating the following algorithm a number of times:

$$\text{MSB}=\text{MSB}+\text{MSB}_{correction} \tag{1}$$

$$\text{LSB}=\text{round}(M_{LSB}\times(p-M_{MSB}^{-1}\times\text{MSB})) \tag{2}$$

$$MSB_{correction} = \begin{cases} 16 \text{ if } LSB > 15 \\ -16 \text{ if } LSB < 0 \end{cases} \tag{3}$$

Figure 9:
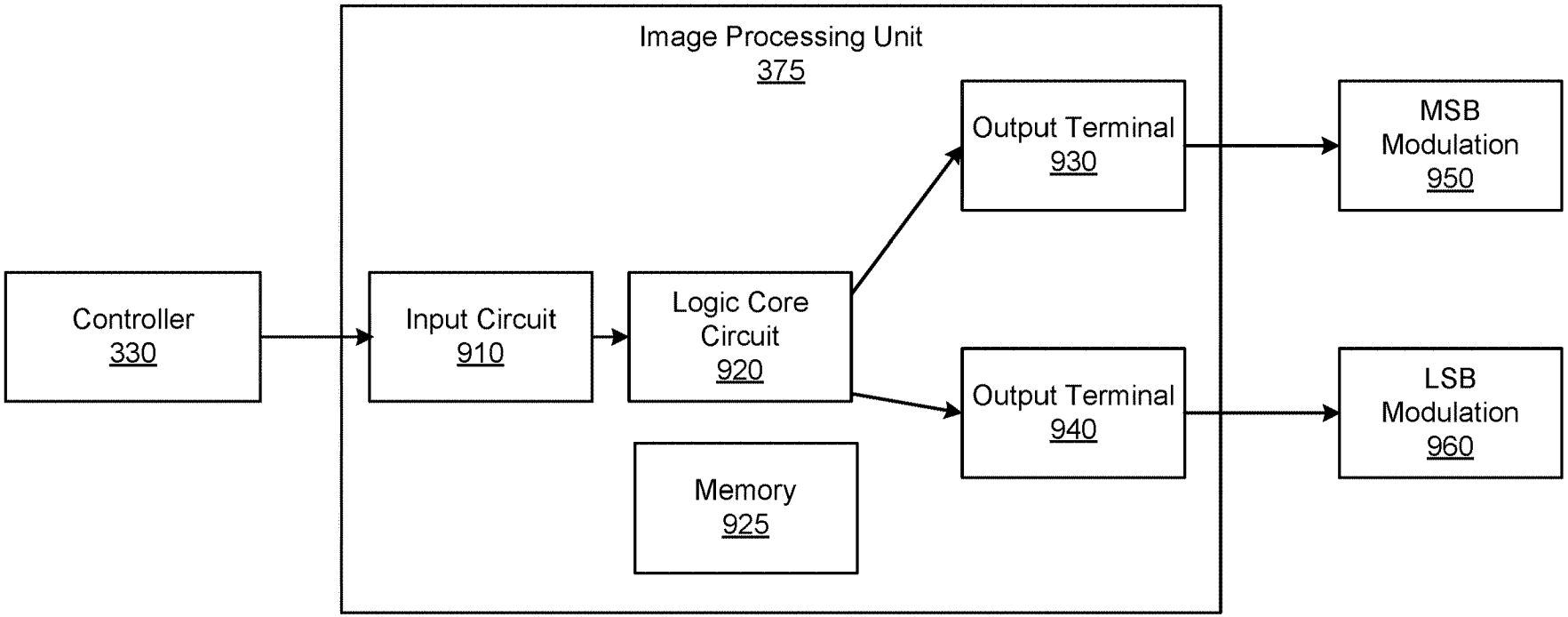
FIG. 9 is a block diagram illustrating the structure of an image processing circuit of a display device, in accordance with an embodiment.

FIG. 9 is a block diagram illustrating the structure of the image processing unit 375, in accordance with an embodiment. The image processing unit 375 may be connected to the controller 330, an MSB modulation unit 950 and an LSB modulation unit 960. The MSB and LSB modulation units 950 and 960 may be part of a driving circuit (such as the driving circuit 370 shown in FIG. 3B). The image processing unit 375 receives input pixel data from the controller 330, and based on the input pixel data, provides outputs to the modulation units. The image processing unit 375 may process one or more image processing operations 800 and/or 850 described in FIGS. 8A and 8B.

While the image processing unit 375 is depicted as another component of the controller 330 in FIG. 9, the image processing unit 375 may also be a sub-component of the controller 330.

The image processing unit 375 may be in any suitable structure that is used to process pixel data. In one embodiment, the image processing unit 375 may include a microprocessor or a microcontroller. In another embodiment, the image processing unit 375 may be a dedicated circuit designed to process the input pixel data. In general, the image processing unit 375 includes input circuit 910, a logic core circuit 920, and a plurality of output terminals 930, 940, etc. The image processing unit 375 may also include a memory 925 for storing data such as one or more look-up tables if look-up tables are used for conversion of color coordinates.

The input circuit 910 includes a receiver to receive multiple sets of input pixel data from the controller 330. Each set of input pixel data represents a color coordinate for a pixel location at a given time. The color coordinate may also be referred to as an original color coordinate before the processing by the image processing unit 375. In one embodiment, the input color coordinate is in the sRGB color coordinate space that has one or more original color coordinate points that are beyond the color gamut 770 (not shown in FIG. 9, but shown in FIG. 7C). The input circuit 910 receives the input pixel data and send the data to the logic core circuit 920 for imaging processing.

The logic core circuit 920 may be implemented using any suitable digital circuit that may include a processor (e.g., a microprocessor or a microcontroller) or may take the form of a dedicated circuit. The logic core circuit 920 performs various image processing operations as described in FIGS. 8A and 8B, including color coordinate conversion, color compensation and warping, dithering, MSB/LSB mapping and correction, etc. In general, the logic core circuit 920 converts the received input pixel data to updated pixel data that represents an updated color coordinate within the common color gamut according to a mapping scheme. The mapping scheme may be implemented by transformation matrices and/or look-up tables that may be stored in the memory 925. The logic core circuit 920 may also perform MSB/LSB mapping and correction to generate an MSB output color coordinate based on the updated pixel data (e.g., a version of the updated pixel data that may be compensated or dithered). The MSB output coordinate is generated also in accordance with the first color gamut 720 (shown in FIG. 7A). Likewise, the logic core circuit 920 may also generate an LSB output color coordinate based on the updated pixel data. The LSB output coordinate is generated also in accordance with the second color gamut 730 (shown in FIG. 7A).

The image processing unit 375 may include one or more output terminals (e.g., output terminals 930 and 940). Connected to the MSB modulation unit 950, the output terminal 930 may generate a first output that includes the first output color coordinate. The first output is used to operate the first light emitters to produce first light in accordance with the first color gamut. For example, the first output is used to generate a first PWM driving signal. Connected to the LSB modulation unit 960, the output terminal 940 may generate a second output that includes the second output color coordinate. The second output is used to operate the second light emitters to produce second light in accordance with the second color gamut. For example, the second output is used to generate a second PWM driving signal.

Figure 10:
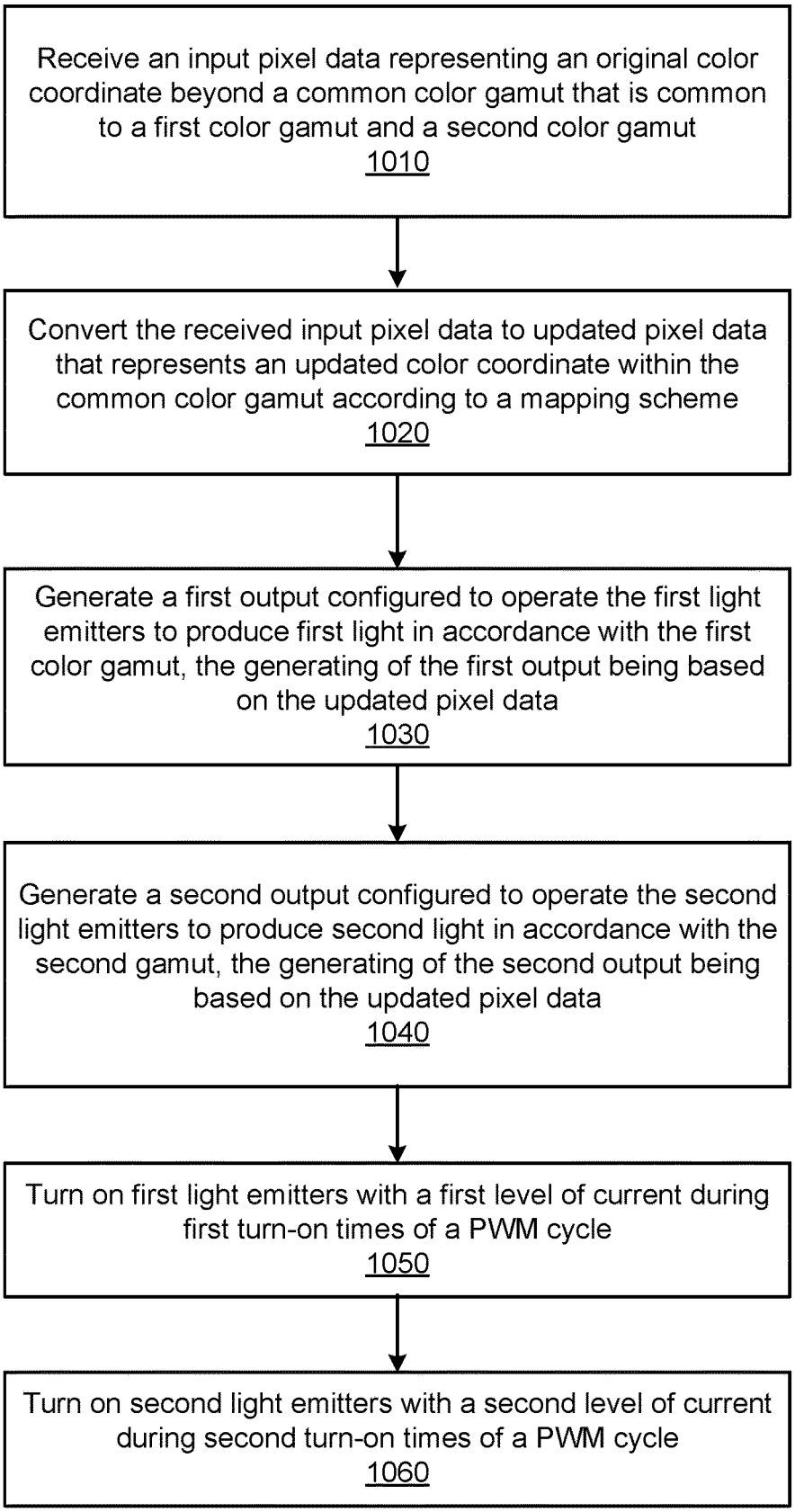
FIG. 10 is a flowchart depicting a process of operating a display device, in accordance with an embodiment.

FIG. 10 is a flowchart depicting a processing of operating a display device, in accordance with an amendment. The process may be operated by a display device that operates light emitters with different PWM current levels. Because of the color shift, the first light emitters generate a first color gamut while the second light emitters generate a second color gamut that is different from the first color gamut. In one embodiment, the first light emitters are responsible for generating light that represents the MSB values of the pixel data while the second light emitters are responsible for generating light that represents the LSB values of the pixel data. Hence, the first light emitters may be referred to as the MSB light emitters (which could include red, green, and blue MSB light emitters) and the second light emitters may be referred to as the LSB light emitters (which could include red, green, and blue LSB light emitters).

In accordance with an embodiment, a display device receives 1010 an input pixel data representing an original color coordinate beyond a common color gamut that is common to the first color gamut and the second color gamut. For example, the input pixel data may be in the sRGB color coordinate space that has some points that are beyond the common area of the first and second gamut regions. The display device converts 1020 the received input pixel data to updated pixel data that represents an updated color coordinate within the common gamut. In one embodiment, the updated color coordinate may be in a second color coordinate space that is different from the color coordinate space of sRGB. For example, the second color coordinate space can be the XYZ tristimulus color coordinate space.

The display device generates 1030 a first output based on the updated pixel data, such as based on a version of the updated pixel data that has been compensated, warped, or dither. In some cases when compensation, warping, or dithering is not performed, the version of the updated pixel data used is the unmodified updated pixel data (e.g., output of block 860 in FIG. 8B). The first output may be generated for the MSB light emitters and include a RGB color coordinate that is corrected for the MSB light emitters. The generation of the first output may involve the use of a correction matrix to account for the color shift in the MSB light emitters. The first output controls the operation of the MSB light emitters to produce first light in accordance with the first color gamut. For example, the first light is a linear combination of the three primary colors that define the first color gamut.

Similarly, the display device generates 1040 a second output based on the updated pixel data. The second output may be generated for the LSB light emitters and include an RGB color coordinate that is corrected for the LSB light emitters. The generation of the second output may involve the use of a correction matrix to account for the color shift in the LSB light emitters. The second output controls the operation of the LSB light emitters to produce the second light in accordance with the second color gamut. For example, the second light is a linear combination of the three primary colors that define the second color gamut.

A driving circuit of the display device generates PWM signals based on the first output and the second output. For example, the first output may include a first output color coordinate that is in an RGB coordinate space corrected for the first light emitters. The driving circuit takes the MSBs of each color of the first output color coordinate to generate the PWM signals. For example, if the PWM scheme is an 8-4-2-1 scheme discussed in FIG. 6 and the MSBs of the red color coordinate 1101, the potentially on-intervals for length 8, 4, and 1 are turned on and the potentially on-intervals for length 2 is off. Other PWM signals for MSB green light emitters and MSB blue light emitters are generated in the same manner. By supplying the PWM signals to the first light emitters, the display device turns on 1050 first light emitters with a first level of current during a PWM cycle.

Similarly and using the second output color coordinate, PWM signals are generated for the second light emitters (LSB light emitters). By supplying the PWM signals to the second light emitters, the display device turns on 1060 second light emitters with a second level of current during the PWM cycle. The overall color at a pixel location is the average of the light generated by the first light emitters and the second light emitters.

This process of image processing and PWM signal generation can be repeated for other PWM cycles for other pixel locations. An image is formed on an image field as a result.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method for operating a display device, comprising:

receiving input pixel data for a pixel location, the input pixel data representing an original color coordinate beyond a common color gamut that is common to (i) a first color gamut generated in the display device by first light emitters and (ii) a second color gamut generated in the display device by second light emitters;

converting the received input pixel data to updated pixel data representing an updated color coordinate within the common color gamut according to a mapping scheme;

generating a first output configured to operate the first light emitters to produce first light in accordance with the first color gamut, the generating of the first output being based on the updated pixel data;

generating a second output configured to operate the second light emitters to produce second light in accordance with the second color gamut, the generating of the second output being based on the updated pixel data;

turning on the first light emitters with a first level of current during a pulse width modulation (PWM) cycle, the first light emitted during the PWM cycle based on the first output, wherein first turn-on times of the first light emitters are defined based on an updated first set of bits converted from the input pixel data; and turning on the second light emitter with a second level of current lower than the first level during the PWM cycle, the second light emitted during the PWM cycle based on the second output, wherein second turn-on times of the second light emitters are defined based on an updated second set of bits converted from the input pixel data.

2. The method of claim 1, wherein the input pixel data is represented in a first color coordinate space and the updated pixel data is represented in a second color coordinate space.

3. The method of claim 2, wherein the first color coordinate space is red, green, blue (RGB) color coordinate space, and the second color coordinate space is XYZ tristimulus color coordinate space.

4. The method of claim 1, further comprising:

performing color compensation on the updated pixel data to generate compensated pixel data, wherein the first output and the second output are generated based on the compensated pixel data.

5. The method of claim 1, further comprising:

performing dithering on the updated pixel data to generate dithered pixel data that changes bit depths of the updated pixel data, wherein the first output and the second output are generated based on the dithered pixel data.

6. The method of claim 1, wherein the mapping scheme is represented by a look-up table stored in a memory.

7. The method of claim 1, wherein generating the first output comprises multiplying a version of the updated pixel data with a first correction matrix and generating the second output comprises multiplying the version of the updated pixel data with a second correction matrix.

8. A display device, comprising:

a first light emitters configured to emit light within a first gamut;

a second light emitters configured to emit light with a second gamut different from the first gamut; and an image processing circuit configured to:

receive input pixel data for a pixel location, the input pixel data representing an original color coordinate beyond a common color gamut that is common to the first gamut and the second gamut;

convert the received input pixel data to updated pixel data representing an updated color coordinate within the common color gamut according to a mapping scheme;

generate a first output configured to operate the first light emitters to produce first light in accordance with the first color gamut, the first output generated based on the updated pixel data;

generate a second output configured to operate the second light emitters to produce second light in accordance with the second color gamut, the generating of the second output being based on the updated pixel data;

turn on the first light emitters with a first level of current during a pulse width modulation (PWM) cycle, the first light emitted during the PWM cycle based on the first output, wherein first turn-on times of the first light emitters are defined based on an updated first set of bits converted from the input pixel data; and turn on the second light emitter with a second level of current lower than the first level during the PWM cycle, the second light emitted during the PWM cycle based on the second output, wherein second turn-on times of the second light emitters are defined based on an updated second set of bits converted from the input pixel data.

9. The display device of claim 8, wherein the input pixel data is represented in a first color coordinate space and the updated pixel data is represented in a second color coordinate space.

10. The method of claim 9, wherein the first color coordinate space is red, green, blue (RGB) color coordinate space, and the second color coordinate space is XYZ tristimulus color coordinate space.

11. The display device of claim 8, wherein the image processing circuit is further configured to:

perform color compensation on the updated pixel data to generate compensated pixel data, wherein the first output and the second output are generated based on the compensated pixel data.

12. The display device of claim 8, wherein the image processing circuit is further configured to:

perform dithering on the updated pixel data to generate dithered pixel data that changes bit depths of the updated pixel data, wherein the first output and the second output are generated based on the dithered pixel data.

13. The display device of claim 8, wherein the mapping scheme is represented by a look-up table stored in a memory.

14. The display device of claim 8, wherein the first output is generated based on multiplying a version of the updated pixel data with a first correction matrix and the second output is generated based on multiplying the version of the updated pixel data with a second correction matrix.

15. An image processing circuit, comprising:

an input circuit configured to receive input pixel data for a pixel location, the input pixel data representing an original color coordinate beyond a common color gamut that is common to a first gamut and a second gamut;

a logic core circuit coupled to the input circuit and configured to convert the received input pixel data to updated pixel data representing an updated color coordinate within the common color gamut according to a mapping scheme;

a first output terminal coupled to the logic core circuit and configured to generate, by processing the updated pixel data, a first output configured to operate first light emitters to produce first light in accordance with the first color gamut, the first output configured to cause the first light emitters to turn on with a first level of current during a pulse width modulation (PWM) cycle, the first light emitted during the PWM cycle based on the first output, wherein first turn-on times of the first light emitters are defined based on an updated first set of bits converted from the input pixel data; and a second output terminal coupled to the logic core circuit and configured to generate, by processing the updated pixel data, a second output configured to operate second light emitters to produce second light in accordance with the second color gamut, the second output configured to cause the second light emitter to turn on with a second level of current lower than the first level during the PWM cycle, the second light emitted during the PWM cycle based on the second output, wherein second turn-on times of the second light emitters are defined based on an updated second set of bits converted from the input pixel data.

16. The image processing circuit of claim 15, wherein the input pixel data is represented in red, green, blue (RGB) color coordinate space and the updated pixel data is represented in XYZ tristimulus color coordinate space.

* * * * *